US012527344B2

(12) United States Patent
Cabot

(10) Patent No.: US 12,527,344 B2
(45) **Date of Patent: *Jan. 20, 2026**

(54) AEROSOLIZABLE FORMULATION

(71) Applicant: NICOVENTURES TRADING LIMITED, London (GB)

(72) Inventor: Ross Cabot, London (GB)

(73) Assignee: NICOVENTURES TRADING LIMITED, London (GB)

( * ) Notice: Subject to any disclaimer, the term of this patent is extended or adjusted under 35 U.S.C. 154(b) by 341 days.

This patent is subject to a terminal disclaimer.

(21) Appl. No.: 17/290,323

(22) PCT Filed: Oct. 31, 2019

(86) PCT No.: PCT/GB2019/053084

§ 371 (c)(1),
(2) Date: Apr. 30, 2021

(87) PCT Pub. No.: WO2020/089631

PCT Pub. Date: May 7, 2020

(65) Prior Publication Data

US 2022/0000167 A1 Jan. 6, 2022

(30) Foreign Application Priority Data

Nov. 1, 2018 (GB) ..... 1817863

(51) Int. Cl.
*A24B 15/167* (2020.01)

(52) U.S. Cl.
CPC ..... *A24B 15/167* (2016.11)

(58) Field of Classification Search
CPC ..... A24B 15/167
See application file for complete search history.

(56) References Cited

U.S. PATENT DOCUMENTS

| | | | |
|---|---|---|---|
| 4,223,292 | A | 9/1980 | Morikawa et al. |
| 4,588,976 | A | 5/1986 | Jaselli |
| 4,735,217 | A | 4/1988 | Gerth et al. |
| 4,922,901 | A | 5/1990 | Brooks et al. |
| 4,945,928 | A | 8/1990 | Rose |
| 5,060,671 | A | 10/1991 | Counts et al. |

(Continued)

FOREIGN PATENT DOCUMENTS

| | | | |
|---|---|---|---|
| AU | 6195998 | A | 6/1998 |
| AU | 17600 | B2 | 3/2000 |

(Continued)

OTHER PUBLICATIONS

Application and File History for U.S. Appl. No. 14/382,198, filed Aug. 29, 2014, inventors Saleem et al.

(Continued)

*Primary Examiner* — Russell E Sparks
(74) *Attorney, Agent, or Firm* — Womble Bond Dickinson (US) LLP; Mark R. DeLuca

(57) ABSTRACT

An aerosolizable formulation comprising (i) water in an amount of at least 50 wt. % based on the aerosolizable formulation; (ii) nicotine; and (iii) one or more acids. A process for forming the aerosolizable formulation, the aerosolizable formulation contained within a container, and aerosolizing the aerosolizable formulation for inhalation by a user with an electronic aerosol provision system.

22 Claims, 8 Drawing Sheets

| | Date -Time | File | Source Name | Dx(10) | Dx(50) | Dx(90) |
|---|---|---|---|---|---|---|
| [V] | 16 Oct 2019-10:43:33.5200 | 191016 Airpro HYDRA 073 1 1 | | 2.08 | 4.22 | 8.51 |
| [V] | 16 Oct 2019-10:45:54.2616 | 191016 Airpro HYDRA 073 3 1 | | 2.07 | 4.29 | 9.78 |
| [V] | 16 Oct 2019-10:47:26.9944 | 191016 Airpro HYDRA 073 4 1 | | 2.11 | 4.28 | 8.92 |

[V]=Volume [N]=Number

*particle size distribution of sample HYDRA 073*

(56) References Cited

U.S. PATENT DOCUMENTS

| | | | | |
|---|---|---|---|---|
| 5,095,921 | A | 3/1992 | Losee et al. | |
| 5,179,966 | A | 1/1993 | Losee et al. | |
| 5,222,362 | A | 6/1993 | Maus et al. | |
| 5,322,075 | A | 6/1994 | Deevi et al. | |
| 5,530,225 | A | 6/1996 | Hajaligol | |
| 5,613,505 | A | 3/1997 | Campbell et al. | |
| 5,666,978 | A | 9/1997 | Counts et al. | |
| 5,692,525 | A | 12/1997 | Counts et al. | |
| 5,771,845 | A | 6/1998 | Pistien et al. | |
| 6,124,579 | A | 9/2000 | Steinhauser et al. | |
| 6,155,268 | A | 12/2000 | Takeuchi | |
| 6,671,450 | B2 | 12/2003 | Khan et al. | |
| 7,374,063 | B2 | 5/2008 | Reid | |
| 8,156,944 | B2 | 4/2012 | Han | |
| 8,948,578 | B2 | 2/2015 | Buchberger | |
| 9,333,229 | B2 | 5/2016 | Bjorncrantz | |
| 9,655,890 | B2 * | 5/2017 | Hearn | A24B 15/00 |
| 10,449,308 | B2 | 10/2019 | Buchberger | |
| 10,602,777 | B2 | 3/2020 | Dickens et al. | |
| 11,064,726 | B2 | 7/2021 | Fujisawa et al. | |
| 2001/0009660 | A1 | 7/2001 | Delli Santi et al. | |
| 2002/0113685 | A1 | 8/2002 | Izaki et al. | |
| 2003/0049025 | A1 | 3/2003 | Neumann et al. | |
| 2003/0159702 | A1 | 8/2003 | Lindell et al. | |
| 2003/0186474 | A1 | 10/2003 | Haluzak et al. | |
| 2004/0034068 | A1 | 2/2004 | Warchol et al. | |
| 2004/0096204 | A1 | 5/2004 | Gerhardinger | |
| 2004/0156792 | A1 | 8/2004 | Tarara | |
| 2004/0247302 | A1 | 12/2004 | Toya et al. | |
| 2005/0063686 | A1 | 3/2005 | Whittle et al. | |
| 2005/0211711 | A1 | 9/2005 | Reid | |
| 2005/0241656 | A1 | 11/2005 | Kennison | |
| 2005/0268911 | A1 | 12/2005 | Cross et al. | |
| 2007/0031343 | A1 | 2/2007 | Bonfour et al. | |
| 2007/0074734 | A1 | 4/2007 | Braunshteyn et al. | |
| 2007/0155255 | A1 | 7/2007 | Galauner et al. | |
| 2007/0267033 | A1 | 11/2007 | Mishra et al. | |
| 2008/0047956 | A1 | 2/2008 | Dudman | |
| 2008/0138399 | A1 | 6/2008 | Gonda | |
| 2008/0216828 | A1 | 9/2008 | Wensley et al. | |
| 2008/0286340 | A1 | 11/2008 | Andersson et al. | |
| 2009/0126745 | A1 | 5/2009 | Hon | |
| 2009/0220222 | A1 | 9/2009 | Rabin et al. | |
| 2009/0272379 | A1 | 11/2009 | Thorens et al. | |
| 2010/0126520 | A1 | 5/2010 | Clayton | |
| 2011/0155153 | A1 | 6/2011 | Thorens et al. | |
| 2011/0226236 | A1 | 9/2011 | Buchberger | |
| 2013/0081623 | A1 | 4/2013 | Buchberger | |
| 2013/0192623 | A1 | 8/2013 | Tucker et al. | |
| 2014/0182608 | A1 | 7/2014 | Egoyants et al. | |
| 2015/0030317 | A1 | 1/2015 | Bayer et al. | |
| 2015/0040925 | A1 | 2/2015 | Saleem et al. | |
| 2015/0059780 | A1 | 3/2015 | Davis et al. | |
| 2016/0157521 | A1 | 6/2016 | Woodcock et al. | |
| 2016/0198759 | A1 | 7/2016 | Kuntawala et al. | |
| 2016/0338407 | A1 | 11/2016 | Kerdemelidis | |
| 2016/0345621 | A1 | 12/2016 | Li et al. | |
| 2017/0119040 | A1 | 5/2017 | Cameron | |
| 2017/0119051 | A1 | 5/2017 | Blandino et al. | |
| 2017/0303594 | A1 | 10/2017 | Cameron et al. | |
| 2017/0325494 | A1 | 11/2017 | Cameron et al. | |
| 2018/0071274 | A1 | 3/2018 | Havercroft et al. | |
| 2018/0199618 | A1 | 7/2018 | Fuisz et al. | |
| 2018/0279667 | A1 | 10/2018 | Mcadam et al. | |
| 2018/0304031 | A1 | 10/2018 | Havercroft et al. | |
| 2019/0116863 | A1 | 4/2019 | Dull | |
| 2020/0315241 | A1 * | 10/2020 | Rubenstein | A24B 13/00 |
| 2020/0345058 | A1 * | 11/2020 | Bowen | A61K 31/465 |
| 2021/0196700 | A1 | 7/2021 | Nolan et al. | |
| 2022/0132906 | A1 | 5/2022 | Mcadam et al. | |
| 2023/0165299 | A1 | 6/2023 | Cabot | |
| 2023/0180818 | A1 | 6/2023 | Cabot | |
| 2023/0270154 | A1 | 8/2023 | Cabot | |

FOREIGN PATENT DOCUMENTS

| | | | | |
|---|---|---|---|---|
| AU | 2019276357 | A1 | 11/2020 | |
| AU | 2019371079 | B2 | 7/2022 | |
| CN | 1708241 | A | 12/2005 | |
| CN | 101390659 | A | 3/2009 | |
| CN | 101404902 | A | 4/2009 | |
| CN | 101583354 | A | 11/2009 | |
| CN | 201375023 | Y | 1/2010 | |
| CN | 102753047 | A | 10/2012 | |
| CN | 104585866 | A | 5/2015 | |
| CN | 104970445 | A | 10/2015 | |
| CN | 105029677 | A | 11/2015 | |
| CN | 105979805 | A | 9/2016 | |
| CN | 106413697 | A | 2/2017 | |
| CN | 106572706 | A | 4/2017 | |
| CN | 107105756 | A | 8/2017 | |
| CN | 107529828 | A | 1/2018 | |
| CN | 107949284 | A | 4/2018 | |
| CN | 108289496 | A | 7/2018 | |
| CN | 108323827 | A | 7/2018 | |
| DE | 102015117811 | | 4/2017 | |
| EP | 2110033 | A1 | 10/2009 | |
| EP | 2316286 | A1 | 5/2011 | |
| EP | 2340729 | A1 | 7/2011 | |
| EP | 2842640 | A1 | 3/2015 | |
| EP | 3574902 | | 12/2019 | |
| GB | 2569940 | | 7/2019 | |
| GB | 2569940 | A | 7/2019 | |
| JP | H03277265 | A | 12/1991 | |
| JP | H0462094 | U | 5/1992 | |
| JP | H1189551 | A | 4/1999 | |
| JP | 2004298331 | A | 10/2004 | |
| JP | 2005511178 | A1 | 4/2005 | |
| JP | 2005533770 | A | 11/2005 | |
| JP | 2009525746 | A | 7/2009 | |
| JP | 2009537120 | A | 10/2009 | |
| JP | 2010516243 | A | 5/2010 | |
| JP | 2012210223 | A | 11/2012 | |
| JP | 2014526240 | A | 10/2014 | |
| JP | 2016073307 | A | 5/2016 | |
| JP | 2016526873 | A | 9/2016 | |
| JP | 2017523785 | A | 8/2017 | |
| JP | 2017536816 | A | 12/2017 | |
| JP | 2021523256 | A | 9/2021 | |
| JP | 2021526147 | A | 9/2021 | |
| JP | 2022506068 | A | 1/2022 | |
| JP | 2022506094 | A | 1/2022 | |
| KR | 20120101118 | A | 9/2012 | |
| KR | 20160008271 | A | 1/2016 | |
| NZ | 536863 | A * | 5/2007 | A61K 31/465 |
| RU | 2048780 | c1 | 11/1995 | |
| RU | 2070062 | C1 | 12/1996 | |
| RU | 2336001 | C2 | 10/2008 | |
| RU | 2536115 | C2 | 12/2014 | |
| RU | 2542547 | C2 | 2/2015 | |
| RU | 2607535 | C2 | 1/2017 | |
| RU | 2653467 | C2 | 5/2018 | |
| RU | 2655188 | C2 | 5/2018 | |
| RU | 2666666 | C1 | 9/2018 | |
| RU | 2736854 | C1 | 11/2020 | |
| WO | 0167819 | A1 | 9/2001 | |
| WO | 03037412 | A2 | 5/2003 | |
| WO | 03049535 | A1 | 6/2003 | |
| WO | 03055486 | A1 | 7/2003 | |
| WO | 03101454 | A1 | 12/2003 | |
| WO | 03103387 | A2 | 12/2003 | |
| WO | 2004060351 | A2 | 7/2004 | |
| WO | 2004076289 | A2 | 9/2004 | |
| WO | 2007091181 | A2 | 8/2007 | |
| WO | 2007138462 | A2 | 12/2007 | |
| WO | 2008069972 | A2 | 6/2008 | |
| WO | 2008069970 | A3 | 10/2008 | |
| WO | 2008146543 | A1 | 12/2008 | |
| WO | 2010045671 | A1 | 4/2010 | |
| WO | 2010107613 | A1 | 9/2010 | |
| WO | 2011045609 | A1 | 4/2011 | |
| WO | 2011079932 | A1 | 7/2011 | |
| WO | 2013034488 | A2 | 3/2013 | |

(56) References Cited

FOREIGN PATENT DOCUMENTS

| | | | |
|---|---|---|---|
| WO | 2013068304 | A1 | 5/2013 |
| WO | 2013161987 | A1 | 10/2013 |
| WO | 2014140320 | A1 | 9/2014 |
| WO | 2014187770 | A2 | 11/2014 |
| WO | 2015006465 | A1 | 1/2015 |
| WO | 2015009862 | A3 | 4/2015 |
| WO | 2015177252 | A1 | 11/2015 |
| WO | 2016020675 | A1 | 2/2016 |
| WO | 2016071705 | A1 | 5/2016 |
| WO | 2016096745 | A1 | 6/2016 |
| WO | 2016115250 | A1 | 7/2016 |
| WO | 2016145072 | A1 | 9/2016 |
| WO | 2017103136 | A1 | 6/2017 |
| WO | 2017175218 | A2 | 10/2017 |
| WO | 2018023890 | A1 | 2/2018 |
| WO | 2018064032 | A1 | 4/2018 |
| WO | 2019086856 | A1 | 5/2019 |
| WO | 2019086858 | A1 | 5/2019 |
| WO | 2020089637 | A1 | 5/2020 |
| WO | 2020089640 | A1 | 5/2020 |

OTHER PUBLICATIONS

British and European Pharmacopoeia 6.0, "2.9.31 Particle Size Analysis By Laser Light Diffraction," British Pharmacopoeia Commission (2014), Stationery Office and Council of Europe (2013), pp. 311-314.

Clayton P.M., et al., "Spectroscopic Investigations into the Acid-Base Properties of Nicotine at Different Temperatures," Analytical Methods, 2013, vol. 5, pp. 81-88.

Davies, et al., "Metallic Foams: Their Production, Properties and Applications," Journal of Materials Science, 1983, vol. 18(7), pp. 1899-1911.

Examination Report No. 2 for Australian Application No. 2019370810, mailed on Jun. 15, 2022, 4 pages.

First Office Action and Search Report for Chinese Patent Application No. 2019800769594, mailed on Mar. 8, 2022, 14 pages.

First Office Action and Search Report for Chinese Patent Application No. 2019800779026, mailed on Mar. 28, 2022, 9 pages.

International Preliminary Report on Patentability for Application No. PCT/AT2011/000123, mailed Sep. 20, 2012, 6 pages.

International Preliminary Report on Patentability for Application No. PCT/GB2019/053094, mailed on Nov. 25, 2020, 6 pages.

International Search Report and Written Opinion for Application No. PCT/EP2013/057539, mailed on Feb. 11, 2014, 16 pages.

International Search Report and Written Opinion for Application No. PCT/GB2019/053092, mailed on Feb. 4, 2020, 10 pages.

International Search Report and Written Opinion for Application No. PCT/GB2019/053094, mailed on Feb. 4, 2020, 14 pages.

International Search Report and Written Opinion for Application No. PCT/GB2019/053095, mailed on Feb. 4, 2020, 13 pages.

International Search Report and Written Opinion for Application No. PCT/AT2011/000123, mailed on Jul. 18, 2011, 8 pages.

Notice of Acceptance mailed Mar. 23, 2022 for Australian Patent Application No. 2019370808, 3 pages.

Office Action mailed Sep. 29, 2015 for Japanese Application No. 2015-506185 filed Apr. 11, 2013, 5 pages.

Office Action and Search Report for Chinese Application No. 201980069806.7, mailed on Feb. 9, 2022, 20 pages.

Office Action and Search Report mailed Dec. 8, 2021 for Russian Application No. 2021112089, 15 pages.

Office Action for Chinese Application No. 201980075317.2., mailed on Feb. 23, 2022, 9 pages.

Office Action for Chinese Application No. 201980075317.2., mailed on Jun. 29, 2022, 18 pages.

Office Action for Japanese Application No. 2021-522532, mailed on Jul. 26, 2022, 10 pages.

Office Action for Japanese Application No. 2021-523220, mailed on Aug. 2, 2022, 13 pages.

Office Action for Japanese Application No. 2021-523226, mailed on Jul. 26, 2022, 13 pages.

Search Report for Japanese Application No. 2021-522532, mailed Jul. 20, 2022, 58 pages.

Search Report for Russian Application No. 2021112073 mailed on Dec. 14, 2021, 2 pages.

Search Report for Russian Application No. 2021112078 mailed on Jan. 26, 2022, 3 pages.

Search Report mailed Oct. 15, 2014 for Japanese Application No. 2012-556343, 18 pages.

Warrier M., et al., "Effect of the Porous Structure of Graphite on Atomic Hydrogen Diffusion and Inventory," Nucl. Fusion, vol. 47, 2007, pp. 1656-1663.

International Search Report and Written Opinion for PCT/GB2019/053084 date mailed Feb. 4, 2020.

"Decision of Refusal received for Japanese Patent Application No. 2021-522532, mailed on Jan. 4, 2023", 8 pages (4 pages of English Translation and 4 pages of Official Copy).

"Decision of Refusal received for Japanese Patent Application No. 2021-523256, mailed on Feb. 21, 2023", 8 pages (4 pages of English Translation and 4 pages of Official Copy).

"International Preliminary Report on Patentability received for PCT Patent Application No. PCT/GB2019/053084, mailed on May 14, 2021", 8 Pages.

"International Preliminary Report on Patentability received for PCT Patent Application No. PCT/GB2019/053092, mailed on May 14, 2021", 7 Pages.

"International Preliminary Report on Patentability received for PCT Patent Application No. PCT/GB2019/053095, mailed on May 14, 2021", 7 Pages.

"Notice of Allowance received for Chinese Patent Application No. 201980076959.4, mailed on Sep. 5, 2022", 6 pages (2 pages of English Translation and 4 pages of Official Copy).

"Notice of Reasons for Refusal received for Japanese Patent Application No. 2021-523226 mailed on Feb. 21, 2023", 8 pages (4 pages of English Translation and 4 pages of Official Copy).

"Office Action received for Canadian Patent Application No. 3,118,059, mailed on Jun. 15, 2023", 5 pages.

"Office Action received for Japanese Patent Application No. 2021-523256, mailed on Jul. 26, 2020", 13 pages (6 pages of English Translation and 7 pages of Official Copy of Search Copy).

"Report of Reconsideration by Examiner before Appeal for Japanese Patent Application No. 2021-522532, dated Jun. 13, 2023", 5 pages (2 pages of English Translation and 3 pages of Official Copy).

"Search Report for Russian Application No. 2021112009, mailed Dec. 27, 2021", 2 pages (Official Copy Only).

Martin , et al., "Nebulizers for Drug Delivery to the Lungs", Expert Opinion on Drug Delivery, vol. 12, No. 6, Dec. 2014, pp. 889-900.

Shekunov , et al., "Particle Size Analysis in Pharmaceutics: Principles, Methods and Applications", Pharmaceutical Research, vol. 24, No. 2, Feb. 2007, pp. 203-227.

Office Action issued on Dec. 27, 2017 for U.S. Appl. No. 14/927,556.

* cited by examiner

| | Date -Time | File | Source Name | Dx(10) | Dx(50) | Dx(90) |
|---|---|---|---|---|---|---|
| [V] | 16 Oct 2019-10:16:54.6904 | 191020 Airpro HYDRA 066 1 1 | | 1.84 | 5.13 | 10.89 |
| [V] | 16 Oct 2019-10:18:05.8860 | 191020 Airpro HYDRA 066 2 1 | | 0.46 | 5.03 | 10.10 |
| [V] | 16 Oct 2019-10:19:20.3564 | 191020 Airpro HYDRA 066 3 1 | | 1.85 | 5.04 | 10.03 |

[V]=Volume [N]=Number

*particle size distribution of sample HYDRA 066*

| | Date -Time | File | Source Name | Dx(10) | Dx(50) | Dx(90) |
|---|---|---|---|---|---|---|
| [V] | 16 Oct 2019-10:23:56.0644 | 191016 Airpro HYDRA 055 1 1 | | 2.06 | 4.58 | 9.17 |
| [V] | 16 Oct 2019-10:25:05.9108 | 191016 Airpro HYDRA 055 2 1 | | 2.11 | 4.60 | 9.19 |
| [V] | 16 Oct 2019-10:26:07.9512 | 191016 Airpro HYDRA 055 3 1 | | 2.16 | 4.77 | 9.62 |

[V]=Volume [N]=Number

*particle size distribution of sample HYDRA 055*

| | Date -Time | File | Source Name | Dx(10) | Dx(50) | Dx(90) |
|---|---|---|---|---|---|---|
| [V] | 16 Oct 2019-10:28:50.9248 | 191016 Airpro HYDRA 056 1 1 | | 2.10 | 4.57 | 9.13 |
| [V] | 16 Oct 2019-10:29:54.4528 | 191016 Airpro HYDRA 056 2 1 | | 2.17 | 4.77 | 9.59 |
| [V] | 16 Oct 2019-10:30:57.9292 | 191016 Airpro HYDRA 056 3 1 | | 2.07 | 4.63 | 9.30 |

[V]=Volume [N]=Number

*particle size distribution of sample HYDRA 056*

| | Date -Time | File | Source Name | Dx(10) | Dx(50) | Dx(90) |
|---|---|---|---|---|---|---|
| [V] | 16 Oct 2019-10:34:13.8140 | 191016 Airpro HYDRA 072 1 1 | | 2.07 | 4.18 | 8.48 |
| [V] | 16 Oct 2019-10:35:23.2388 | 191016 Airpro HYDRA 072 2 1 | | 2.12 | 4.09 | 7.60 |
| [V] | 16 Oct 2019-10:37:02.3480 | 191016 Airpro HYDRA 072 3 1 | | 2.09 | 4.23 | 8.61 |

[V]=Volume [N]=Number

*particle size distribution of sample HYDRA 072*

| | Date -Time | File | Source Name | Dx(10) | Dx(50) | Dx(90) |
|---|---|---|---|---|---|---|
| [V] | 16 Oct 2019-10:43:33.5200 | 191016 Airpro HYDRA 073 1 1 | | 2.08 | 4.22 | 8.51 |
| [V] | 16 Oct 2019-10:45:54.2616 | 191016 Airpro HYDRA 073 3 1 | | 2.07 | 4.29 | 9.78 |
| [V] | 16 Oct 2019-10:47:26.9944 | 191016 Airpro HYDRA 073 4 1 | | 2.11 | 4.28 | 8.92 |

[V]=Volume [N]=Number

*particle size distribution of sample HYDRA 073*

| | Date -Time | File | Source Name | Dx(10) | Dx(50) | Dx(90) |
|---|---|---|---|---|---|---|
| [V] | 16 Oct 2019-10:50:04.3232 | 191016 Airpro HYDRA 074 1 1 | | 2.11 | 4.37 | 9.45 |
| [V] | 16 Oct 2019-10:51:10.6504 | 191016 Airpro HYDRA 074 2 1 | | 2.05 | 4.13 | 8.49 |
| [V] | 16 Oct 2019-10:52:36.6136 | 191016 Airpro HYDRA 074 3 1 | | 2.09 | 4.23 | 8.49 |

[V]=Volume [N]=Number

*particle size distribution of sample HYDRA 074*

AEROSOLIZABLE FORMULATION

PRIORITY CLAIM

The present application is a National Phase entry of PCT Application No. PCT/GB2019/053084, filed Oct. 31, 2019 which claims priority from GB Patent Application No. 1817863.2 filed Nov. 1, 2018, each of which is hereby fully incorporated herein by reference.

FIELD OF THE INVENTION

The present disclosure relates to an aerosolizable formulation, a method of forming the same, a container containing the same, a device containing the same and processes and uses of the same.

BACKGROUND TO THE INVENTION

Electronic aerosol provision systems such as e-cigarettes generally contain a reservoir of liquid which is to be vaporized, typically containing nicotine. When a user inhales on the device, a heater is activated to vaporize a small amount of liquid, which is therefore inhaled by the user.

The use of e-cigarettes in the UK has grown rapidly, and it has been estimated that there are now over a million people using them in the UK.

One challenge faced in providing such systems is to provide from the aerosol provision device an aerosol to be inhaled which provides consumers with an acceptable experience. Some consumers may prefer an e-cigarette that generates an aerosol that closely 'mimics' smoke inhaled from a tobacco product such as a cigarette. Aerosols from e-cigarettes and smoke from tobacco products such as cigarettes provides to the user a complex chain of flavor in the mouth, nicotine absorption in the mouth and throat, followed by nicotine absorption in the lungs. These various aspects are described by users in terms of flavor, intensity/quality, impact, irritation/smoothness and nicotine reward. Nicotine contributes to a number of these factors, and is strongly associated with factors such as impact, irritation and smoothness; these are readily perceived by consumers, and e-cigarettes may offer too much or too little of these parameters for consumers, depending upon individual preferences. Nicotine reward is particularly complex as it results from both the amount of and speed with which nicotine is absorbed from the lining of the mouth, this is typically nicotine in the vapor phase, and from the amount and speed nicotine that is absorbed from the lungs, this is typically nicotine in the particulate phase of the aerosol which is inhaled. Each of these factors, and their balance, can strongly contribute to consumer acceptability of an e-cigarette. Providing means to optimize the overall vaping experience is therefore desirable to e-cigarette manufacturers.

A further challenge facing such systems is the continued demand for harm reduction. Harm from cigarette and e-cigarette devices primarily comes from toxicants. Therefore, there is a desire to reduce or remove the components which may form toxicants.

SUMMARY OF THE INVENTION

In one aspect there is provided an aerosolizable formulation comprising (i) water in an amount of at least 50 wt. % based on the aerosolizable formulation;

(ii) nicotine; and (iii) one or more acids.

In one aspect there is provided a process for forming an aerosol, the process comprising aerosolizing an aerosolizable formulation comprising (i) water in an amount of at least 50 wt. % based on the aerosolizable formulation;

(ii) nicotine; and (iii) one or more acids.

In one aspect there is provided a contained aerosolizable formulation comprising (a) a container; and (b) an aerosolizable formulation, comprising (i) water in an amount of at least 50 wt. % based on the aerosolizable formulation;

(ii) nicotine; and (iii) one or more acids.

In one aspect there is provided an electronic aerosol provision system comprising:

(a) an aerosolizer for aerosolizing formulation for inhalation by a user of the electronic aerosol provision system;

(b) a power supply comprising a cell or battery for supplying power to the aerosolizer (c) an aerosolizable formulation, comprising (i) water in an amount of at least 50 wt. % based on the aerosolizable formulation;

(ii) nicotine; and (iii) one or more acids.

In one aspect there is provided a process for improving the sensory properties of an aerosolized nicotine formulation, the process comprising the steps of (a) providing an aerosolizable material comprising (i) water in an amount of at least 50 wt. % based on the aerosolizable material and (ii) nicotine;

(b) incorporating into the aerosolizable material one or more acids.

In one aspect there is provided use of one or more acids for improving sensory properties of an aerosolized nicotine formulation, wherein the nicotine formulation comprises (i) water in an amount of at least 50 wt. % based on the aerosolizable formulation;

(ii) nicotine; and (iii) one or more acids.

BRIEF DESCRIPTION OF THE DRAWINGS

The present disclosure will now be described in further detail by way of example only with reference to the accompanying figures in which.

DETAILED DESCRIPTION

Figure 1:
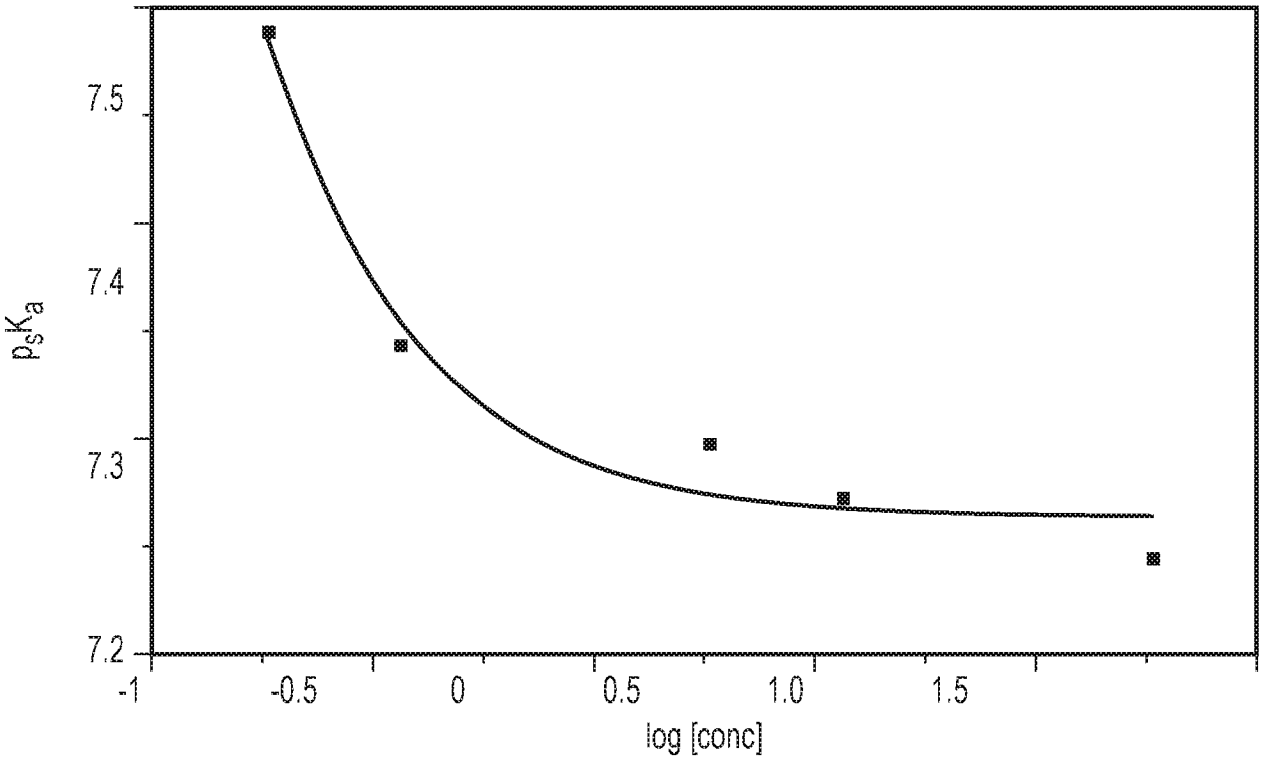
FIG. 1 shows a graph illustrating variation of $p_sK_{a2}$ with nicotine concentration.
Figure 2A:
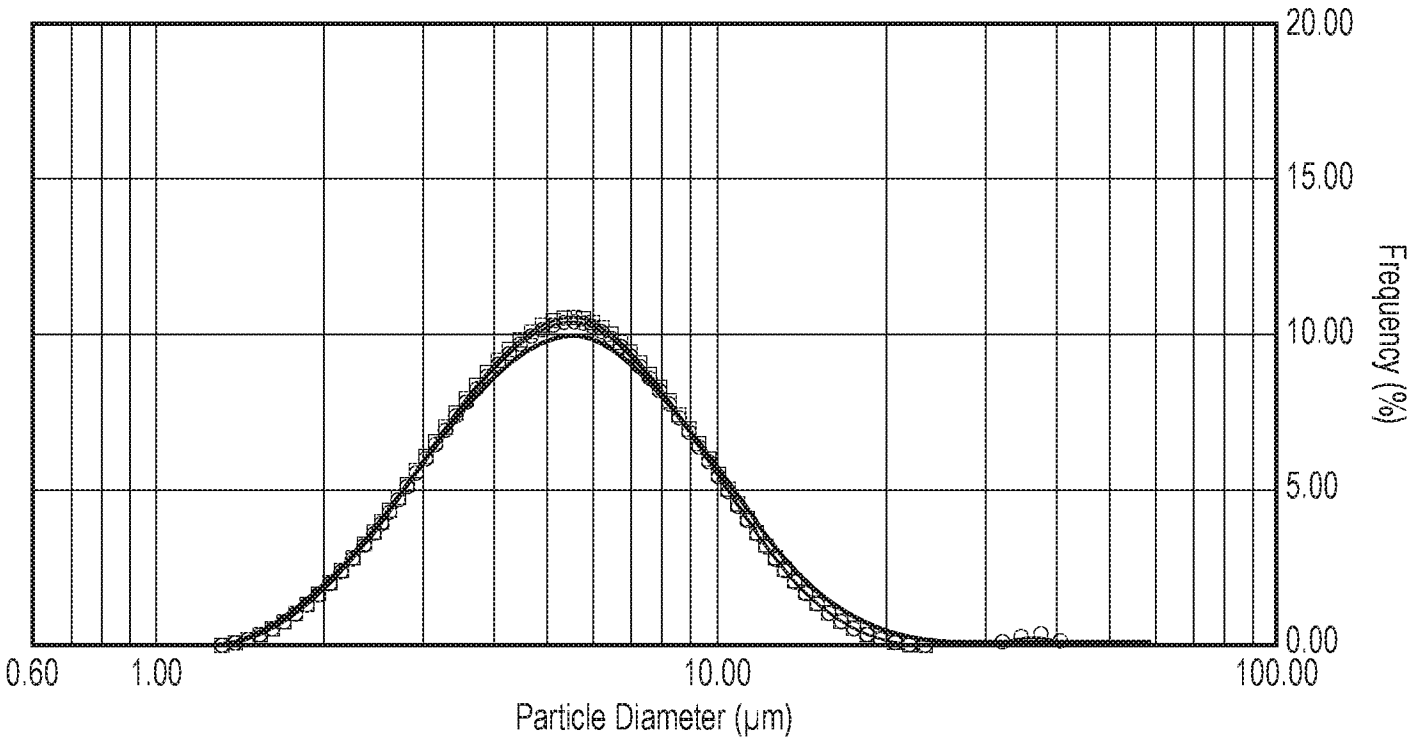
FIG. 2A shows particle size distribution of an inhaled sample, the sample having formulation code HYDRA-066 shown in Table 1, according to certain embodiments of the present disclosure.
Figure 2B:
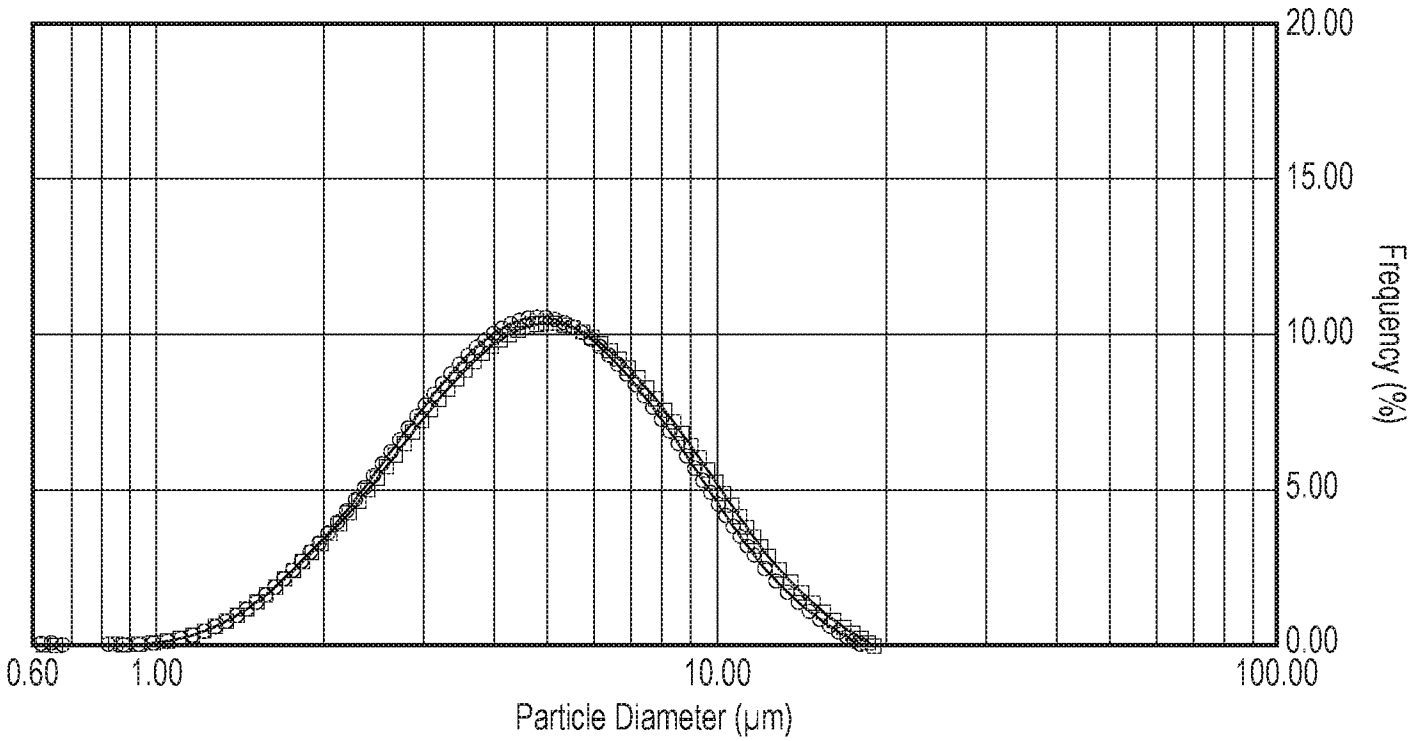
FIG. 2B shows particle size distribution of an inhaled sample, the sample having formulation code HYDRA-055 shown in Table 1, according to certain embodiments of the present disclosure.
Figure 2C:
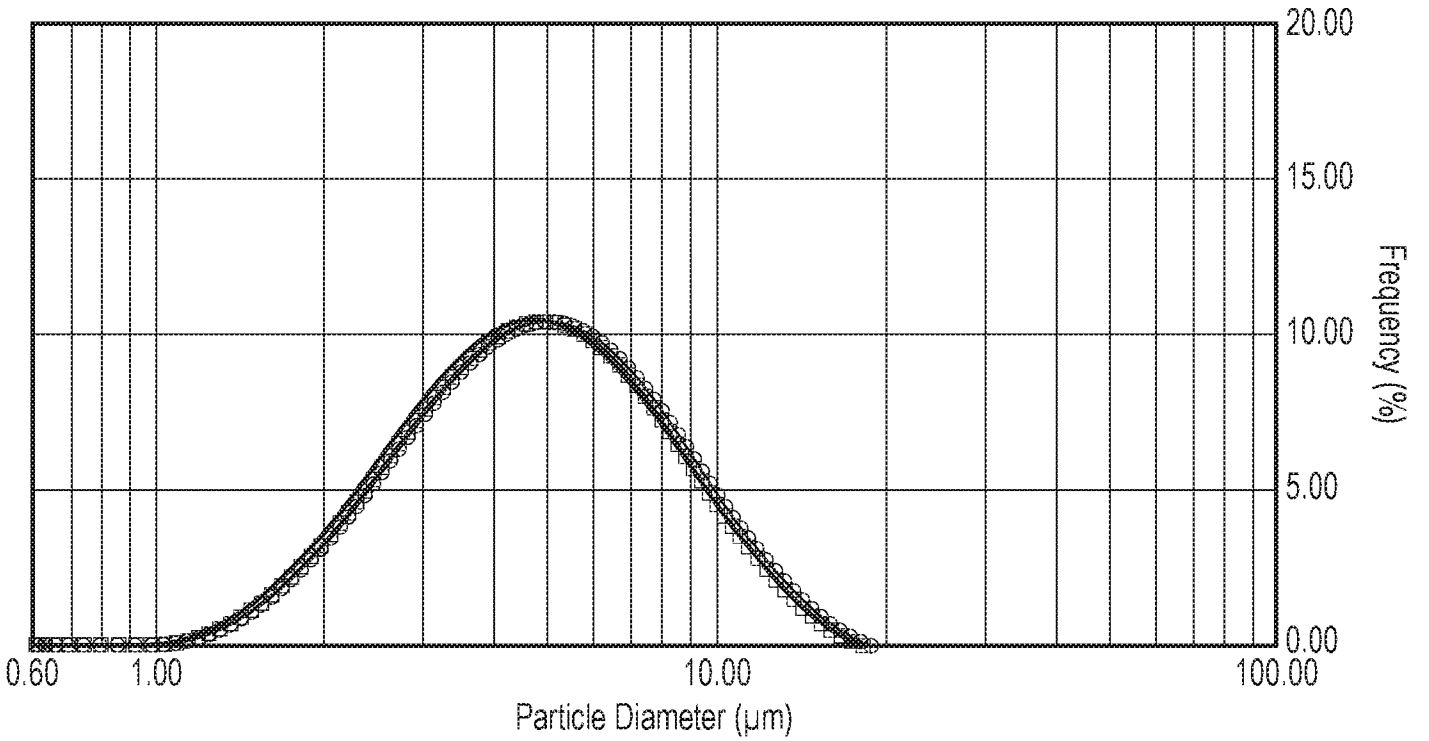
FIG. 2C shows particle size distribution of an inhaled sample, the sample having formulation code HYDRA-056 shown in Table 1, according to certain embodiments of the present disclosure.
Figure 2D:
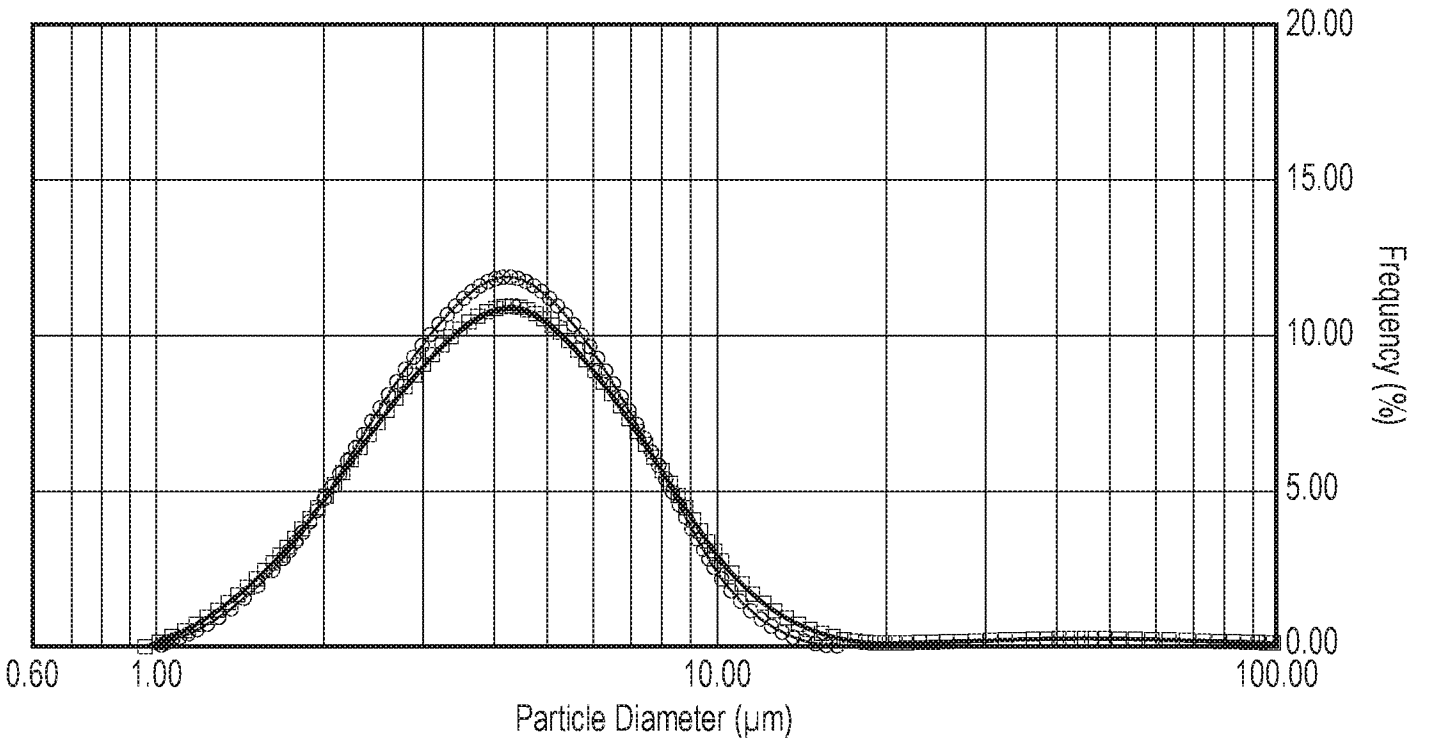
FIG. 2D shows particle size distribution of an inhaled sample, the sample having formulation code HYDRA-072 shown in Table 1, according to certain embodiments of the present disclosure.
Figure 2E:
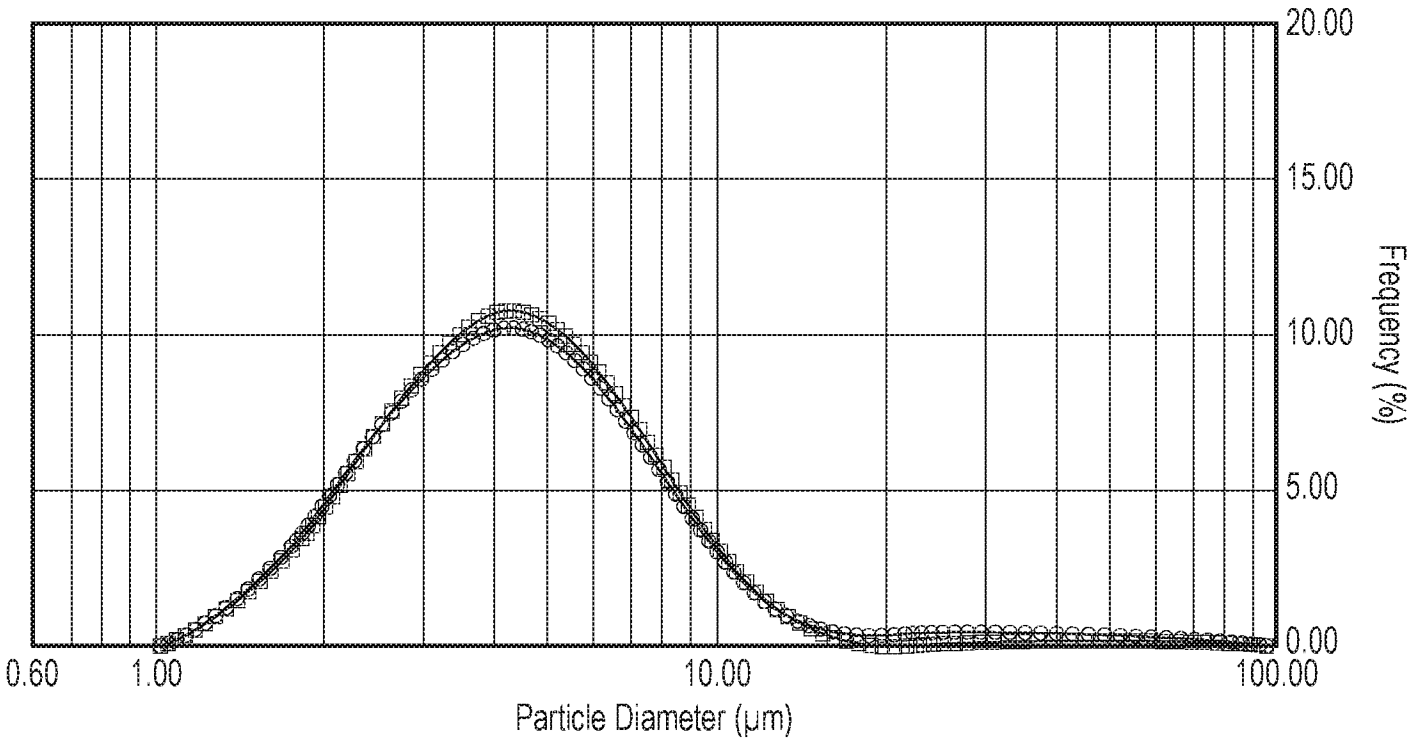
FIG. 2E shows particle size distribution of an inhaled sample, the sample having formulation code HYDRA-073 shown in Table 1, according to certain embodiments of the present disclosure.
Figure 2F:
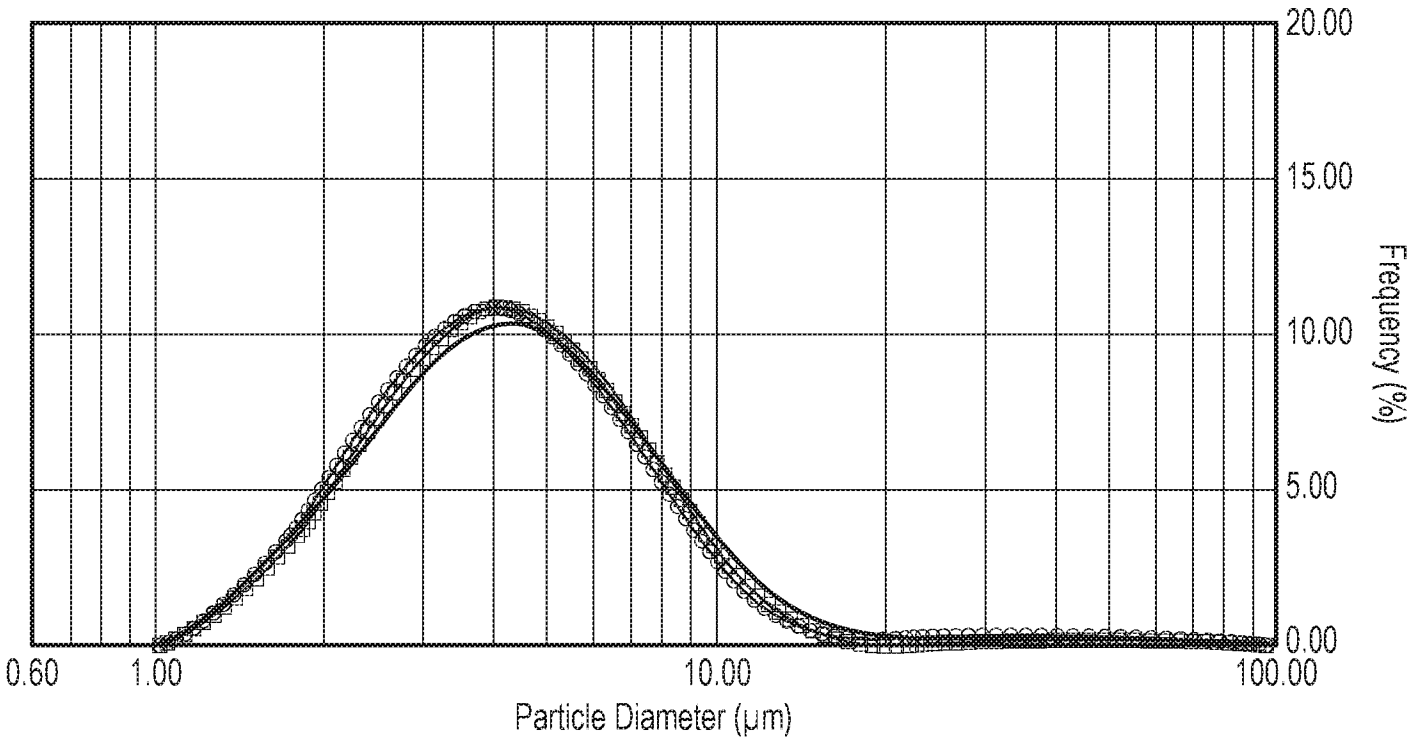
FIG. 2F shows particle size distribution of an inhaled sample, the sample having formulation code HYDRA-074 shown in Table 1, according to certain embodiments of the present disclosure.

As discussed herein in one aspect there is provided an aerosolizable formulation comprising (i) water in an amount of at least 50 wt. % based on the aerosolizable formulation;

(ii) nicotine; and (iii) one or more acids.

We have found that an advantageous system may be provided which contains a high content of water and in which an acid is provided together with the nicotine. The acid protonates the nicotine and we have found that such protonation in a system containing at least 50 wt % water, provides control over release of nicotine. In particular, in the present system control is provided, for example by controlling the degree of protonation, over the location where the nicotine is released or deposited when inhaled by the user. For example by controlling the degree of protonation, more or less of the nicotine may be delivered to the deep lungs of the user. This is in contrast to 'traditional' e-liquids based on glycerol and propylene glycol in which free nicotine is more likely to be trapped in glycerol/propylene glycol as is any protonated nicotine.

As is understood by one skilled in the art, nicotine may exist in unprotonated form, monoprotonated form or diprotonated form. The structures of each of these forms are given below.

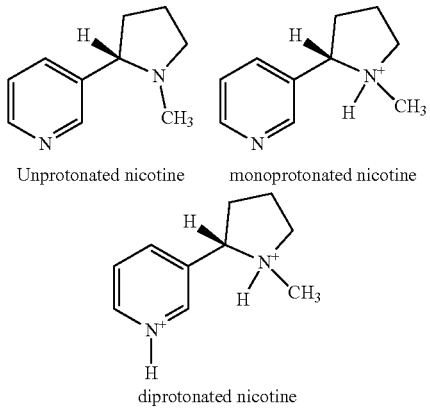

Reference in the specification to protonated form means both monoprotonated nicotine and diprotonated nicotine. Reference in the specification to amounts in the protonated form means the combined amount of monoprotonated nicotine and diprotonated nicotine. Furthermore, when reference is made to a fully protonated formulation it will be understood that at any one time there may be very minor amounts of unprotonated nicotine present, e.g. less than 1% unprotonated.

For ease of reference, these and further aspects of the present invention are now discussed under appropriate section headings. However, the teachings under each section are not necessarily limited to each particular section.

Water

As discussed herein the aerosolizable formulation comprises water in an amount of at least 50 wt. % based on the aerosolizable formulation. In one aspect water is present in an amount of at least 55 wt. % based on the aerosolizable formulation. In one aspect water is present in an amount of at least 60 wt. % based on the aerosolizable formulation. In one aspect water is present in an amount of at least 65 wt. % based on the aerosolizable formulation. In one aspect water is present in an amount of at least 70 wt. % based on the aerosolizable formulation. In one aspect water is present in an amount of at least 75 wt. % based on the aerosolizable formulation. In one aspect water is present in an amount of at least 80 wt. % based on the aerosolizable formulation. In one aspect water is present in an amount of at least 85 wt. % based on the aerosolizable formulation. In one aspect water is present in an amount of at least 90 wt. % based on the aerosolizable formulation. In one aspect water is present in an amount of at least 95 wt. % based on the aerosolizable formulation. In one aspect water is present in an amount of at least 99 wt. % based on the aerosolizable formulation.

In one aspect water is present in an amount of from 50 to 99 wt. % based on the aerosolizable formulation. In one aspect water is present in an amount of from 55 to 99 wt. % based on the aerosolizable formulation. In one aspect water is present in an amount of from 60 to 99 wt. % based on the aerosolizable formulation. In one aspect water is present in an amount of from 65 to 99 wt. % based on the aerosolizable formulation. In one aspect water is present in an amount of from 70 to 99 wt. % based on the aerosolizable formulation. In one aspect water is present in an amount of from 75 to 99 wt. % based on the aerosolizable formulation. In one aspect water is present in an amount of from 80 to 99 wt. % based on the aerosolizable formulation. In one aspect water is present in an amount of from 85 to 99 wt. % based on the aerosolizable formulation. In one aspect water is present in an amount of from 90 to 99 wt. % based on the aerosolizable formulation. In one aspect water is present in an amount of from 95 to 99 wt. % based on the aerosolizable formulation.

As discussed herein the use of water allows for the replacement of some or all of the glycerol, propylene glycol, 1,3-propane diol and mixtures thereof typically used in e-cigarettes. In one aspect the aerosolizable formulation contains glycerol, propylene glycol, 1,3-propane diol and mixtures thereof in a combined amount of no greater than 10 wt. % based on the aerosolizable formulation. In one aspect the aerosolizable formulation contains glycerol, propylene glycol, 1,3-propane diol and mixtures thereof in a combined amount of no greater than 8 wt. % based on the aerosolizable formulation. In one aspect the aerosolizable formulation contains glycerol, propylene glycol, 1,3-propane diol and mixtures thereof in a combined amount of no greater than 5 wt. % based on the aerosolizable formulation. In one aspect the aerosolizable formulation contains glycerol, propylene glycol, 1,3-propane diol and mixtures thereof in a combined amount of no greater than 2 wt. % based on the aerosolizable formulation. In one aspect the aerosolizable formulation contains glycerol, propylene glycol, 1,3-propane diol and mixtures thereof in a combined amount of no greater than 1 wt. % based on the aerosolizable formulation. In one aspect the aerosolizable formulation contains glycerol, propylene glycol, 1,3-propane diol and mixtures thereof in a combined amount of no greater than 0.5 wt. % based on the aerosolizable formulation. In one aspect the aerosolizable formulation contains glycerol, propylene glycol, 1,3-propane diol and mixtures thereof in a combined amount of no greater than 0.2 wt. % based on the aerosolizable formulation. In one aspect the aerosolizable formulation contains glycerol, propylene glycol, 1,3-propane diol and mixtures thereof in a combined amount of no greater than 0.1 wt. % based on the aerosolizable formulation. In one aspect the aerosolizable formulation contains glycerol, propylene glycol, 1,3-propane diol and mixtures thereof in a combined amount of no greater than 0.01 wt. % based on the aerosolizable formulation. In one aspect the aerosolizable formulation contains no glycerol, propylene glycol, 1,3-propane diol and mixtures thereof.

In one aspect the aerosolizable formulation contains glycerol, propylene glycol, and mixtures thereof in a combined amount of no greater than 10 wt. % based on the aerosolizable formulation. In one aspect the aerosolizable formulation contains glycerol, propylene glycol, and mixtures thereof in a combined amount of no greater than 8 wt. % based on the aerosolizable formulation. In one aspect the aerosolizable formulation contains glycerol, propylene glycol, and mixtures thereof in a combined amount of no greater than 5 wt. % based on the aerosolizable formulation. In one aspect the aerosolizable formulation contains glycerol, propylene glycol, and mixtures thereof in a combined amount of no greater than 2 wt. % based on the aerosolizable formulation. In one aspect the aerosolizable formulation contains glycerol, propylene glycol, and mixtures thereof in a combined amount of no greater than 1 wt. % based on the aerosolizable formulation. In one aspect the aerosolizable formulation contains glycerol, propylene glycol, and mixtures thereof in a combined amount of no greater than 0.5 wt. % based on the aerosolizable formulation. In one aspect the aerosolizable formulation contains glycerol, propylene glycol, and mixtures thereof in a combined amount of no greater than 0.2 wt. % based on the aerosolizable formulation. In one aspect the aerosolizable formulation contains glycerol, propylene glycol, and mixtures thereof in a combined amount of no greater than 0.1 wt. % based on the aerosolizable formulation. In one aspect the aerosolizable formulation contains glycerol, propylene glycol, and mixtures thereof in a combined amount of no greater than 0.01 wt. % based on the aerosolizable formulation. In one aspect the aerosolizable formulation contains no glycerol, propylene glycol, and mixtures thereof.

In one aspect the aerosolizable formulation contains glycerol in an amount of no greater than 10 wt. % based on the aerosolizable formulation. In one aspect the aerosolizable formulation contains glycerol in an amount of no greater than 8 wt. % based on the aerosolizable formulation. In one aspect the aerosolizable formulation contains glycerol in an amount of no greater than 5 wt. % based on the aerosolizable formulation. In one aspect the aerosolizable formulation contains glycerol in an amount of no greater than 2 wt. % based on the aerosolizable formulation. In one aspect the aerosolizable formulation contains glycerol in an amount of no greater than 1 wt. % based on the aerosolizable formulation. In one aspect the aerosolizable formulation contains glycerol in an amount of no greater than 0.5 wt. % based on the aerosolizable formulation. In one aspect the aerosolizable formulation contains glycerol in an amount of no greater than 0.2 wt. % based on the aerosolizable formulation. In one aspect the aerosolizable formulation contains glycerol in an amount of no greater than 0.1 wt. % based on the aerosolizable formulation. In one aspect the aerosolizable formulation contains glycerol in an amount of no greater than 0.01 wt. % based on the aerosolizable formulation. In one aspect the aerosolizable formulation contains no glycerol.

In one aspect the aerosolizable formulation contains propylene glycol in an amount of no greater than 10 wt. % based on the aerosolizable formulation. In one aspect the aerosolizable formulation contains propylene glycol in an amount of no greater than 8 wt. % based on the aerosolizable formulation. In one aspect the aerosolizable formulation contains propylene glycol in an amount of no greater than 5 wt. % based on the aerosolizable formulation. In one aspect the aerosolizable formulation contains propylene glycol in an amount of no greater than 2 wt. % based on the aerosolizable formulation. In one aspect the aerosolizable formulation contains propylene glycol in an amount of no greater than 1 wt. % based on the aerosolizable formulation. In one aspect the aerosolizable formulation contains propylene glycol in an amount of no greater than 0.5 wt. % based on the aerosolizable formulation. In one aspect the aerosolizable formulation contains propylene glycol in an amount of no greater than 0.2 wt. % based on the aerosolizable formulation. In one aspect the aerosolizable formulation contains propylene glycol in an amount of no greater than 0.1 wt. % based on the aerosolizable formulation. In one aspect the aerosolizable formulation contains propylene glycol in an amount of no greater than 0.01 wt. % based on the aerosolizable formulation. In one aspect the aerosolizable formulation contains no propylene glycol.

Nicotine

Nicotine formulations may be provided having desirable properties of flavor, impact, irritation, smoothness and/or nicotine reward for the user. In one aspect nicotine is present in an amount of no greater than 6 wt % based on the total weight of the aerosolizable formulation. In one aspect nicotine is present in an amount of from 0.01 to 6 wt % based on the total weight of the aerosolizable formulation. In one aspect nicotine is present in an amount of from 0.02 to 6 wt % based on the total weight of the aerosolizable formulation. In one aspect nicotine is present in an amount of from 0.05 to 6 wt % based on the total weight of the aerosolizable formulation. In one aspect nicotine is present in an amount of from 0.08 to 6 wt % based on the total weight of the aerosolizable formulation. In one aspect nicotine is present in an amount of from 0.01 to 5 wt % based on the total weight of the aerosolizable formulation. In one aspect nicotine is present in an amount of from 0.02 to 5 wt % based on the total weight of the aerosolizable formulation. In one aspect nicotine is present in an amount of from 0.05 to 5 wt % based on the total weight of the aerosolizable formulation. In one aspect nicotine is present in an amount of from 0.08 to 5 wt % based on the total weight of the aerosolizable formulation. In one aspect nicotine is present in an amount of no greater than 4 wt % based on the total weight of the aerosolizable formulation. In one aspect nicotine is present in an amount of from 0.01 to 4 wt % based on the total weight of the aerosolizable formulation. In one aspect nicotine is present in an amount of from 0.02 to 4 wt % based on the total weight of the aerosolizable formulation. In one aspect nicotine is present in an amount of from 0.05 to 4 wt % based on the total weight of the aerosolizable formulation. In one aspect nicotine is present in an amount of from 0.08 to 4 wt % based on the total weight of the aerosolizable formulation. In one aspect nicotine is present in an amount of no greater than 3 wt % based on the total weight of the aerosolizable formulation. In one aspect nicotine is present in an amount of from 0.01 to 3 wt % based on the total weight of the aerosolizable formulation. In one aspect nicotine is present in an amount of from 0.02 to 3 wt % based on the total weight of the aerosolizable formulation. In one aspect nicotine is present in an amount of from 0.05 to 3 wt % based on the total weight of the aerosolizable formulation. In one aspect nicotine is present in an amount of from 0.08 to 3 wt % based on the total weight of the aerosolizable formulation. In one aspect nicotine is present in an amount of no greater than 2 wt % based on the total weight of the aerosolizable formulation. In one aspect nicotine is present in an amount of from 0.01 to 2 wt % based on the total weight of the aerosolizable formulation. In one aspect nicotine is present in an amount of from 0.02 to 2 wt % based on the total weight of the aerosolizable formulation. In one aspect nicotine is present in an amount of from 0.05 to 2 wt % based on the total weight of the aerosolizable formulation. In one aspect nicotine is present in an amount of from 0.08 to 2 wt % based on the total weight of the aerosolizable formulation. In one aspect nicotine is present in an amount of no greater than 1 wt % based on the total weight of the aerosolizable formulation. In one aspect nicotine is present in an amount of from 0.01 to 1 wt % based on the total weight of the aerosolizable formulation. In one aspect nicotine is present in an amount of from 0.02 to 1 wt % based on the total weight of the aerosolizable formulation. In one aspect nicotine is present in an amount of from 0.05 to 1 wt % based on the total weight of the aerosolizable formulation. In one aspect nicotine is present in an amount of from 0.08 to 1 wt % based on the total weight of the aerosolizable formulation. In one aspect nicotine is present in an amount of from 0.1 to 1 wt % based on the total weight of the aerosolizable formulation. In one aspect nicotine is present in an amount of no greater than 0.6 wt % based on the total weight of the aerosolizable formulation. In one aspect nicotine is present in an amount of from 0.01 to 0.6 wt % based on the total weight of the aerosolizable formulation. In one aspect nicotine is present in an amount of from 0.02 to 0.6 wt % based on the total weight of the aerosolizable formulation. In one aspect nicotine is present in an amount of from 0.05 to 0.6 wt % based on the total weight of the aerosolizable formulation. In one aspect nicotine is present in an amount of from 0.08 to 0.6 wt % based on the total weight of the aerosolizable formulation. In one aspect nicotine is present in an amount of from 0.1 to 0.6 wt % based on the total weight of the aerosolizable formulation. In one aspect nicotine is present in an amount of no greater than 0.5 wt % based on the total weight of the aerosolizable formulation. In one aspect nicotine is present in an amount of from 0.01 to 0.5 wt % based on the total weight of the aerosolizable formulation. In one aspect nicotine is present in an amount of from 0.02 to 0.5 wt % based on the total weight of the aerosolizable formulation. In one aspect nicotine is present in an amount of from 0.05 to 0.5 wt % based on the total weight of the aerosolizable formulation. In one aspect nicotine is present in an amount of from 0.08 to 0.5 wt % based on the total weight of the aerosolizable formulation. In one aspect nicotine is present in an amount of no greater than 0.2 wt % based on the total weight of the aerosolizable formulation. In one aspect nicotine is present in an amount of from 0.01 to 0.2 wt % based on the total weight of the aerosolizable formulation. In one aspect nicotine is present in an amount of from 0.02 to 0.2 wt % based on the total weight of the aerosolizable formulation. In one aspect nicotine is present in an amount of from 0.05 to 0.2 wt % based on the total weight of the aerosolizable formulation. In one aspect nicotine is present in an amount of from 0.08 to 0.2 wt % based on the total weight of the aerosolizable formulation. In one aspect nicotine is present in an amount of no greater than 0.1 wt % based on the total weight of the aerosolizable formulation. In one aspect nicotine is present in an amount of from 0.01 to 0.1 wt % based on the total weight of the aerosolizable formulation. In one aspect nicotine is present in an amount of from 0.02 to 0.1 wt % based on the total weight of the aerosolizable formulation. In one aspect nicotine is present in an amount of from 0.05 to 0.1 wt % based on the total weight of the aerosolizable formulation. In one aspect nicotine is present in an amount of from 0.08 to 0.1 wt % based on the total weight of the aerosolizable formulation.

The formulation comprises nicotine in protonated form. The formulation may comprise nicotine in unprotonated form. In one aspect the formulation comprises nicotine in unprotonated form and nicotine in monoprotonated form. In one aspect the formulation comprises nicotine in unprotonated form and nicotine in diprotonated form. In one aspect the formulation comprises nicotine in unprotonated form, nicotine in monoprotonated form and nicotine in diprotonated form.

In one aspect at least 5 wt % of the nicotine present in the formulation is in protonated form. In one aspect at least 10 wt % of the nicotine present in the formulation is in protonated form. In one aspect at least 15 wt % of the nicotine present in the formulation is in protonated form. In one aspect at least 20 wt % of the nicotine present in the formulation is in protonated form. In one aspect at least 25 wt % of the nicotine present in the formulation is in protonated form. In one aspect at least 30 wt % of the nicotine present in the formulation is in protonated form. In one aspect at least 35 wt % of the nicotine present in the formulation is in protonated form. In one aspect at least 40 wt % of the nicotine present in the formulation is in protonated form. In one aspect at least 45 wt % of the nicotine present in the formulation is in protonated form. In one aspect at least 50 wt % of the nicotine present in the formulation is in protonated form. In one aspect at least 55 wt % of the nicotine present in the formulation is in protonated form. In one aspect at least 60 wt % of the nicotine present in the formulation is in protonated form. In one aspect at least 65 wt % of the nicotine present in the formulation is in protonated form. In one aspect at least 70 wt % of the nicotine present in the formulation is in protonated form. In one aspect at least 75 wt % of the nicotine present in the formulation is in protonated form. In one aspect at least 80 wt % of the nicotine present in the formulation is in protonated form. In one aspect at least 85 wt % of the nicotine present in the formulation is in protonated form. In one aspect at least 90 wt % of the nicotine present in the formulation is in protonated form. In one aspect at least 95 wt % of the nicotine present in the formulation is in protonated form. In one aspect at least 99 wt % of the nicotine present in the formulation is in protonated form. In one aspect at least 99.9 wt % of the nicotine present in the formulation is in protonated form.

In one aspect from 50 to 95 wt % of the nicotine present in the formulation is in protonated form. In one aspect from 55 to 95 wt % of the nicotine present in the formulation is in protonated form. In one aspect from 60 to 95 wt % of the nicotine present in the formulation is in protonated form. In one aspect from 65 to 95 wt % of the nicotine present in the formulation is in protonated form. In one aspect from 70 to 95 wt % of the nicotine present in the formulation is in protonated form. In one aspect from 75 to 95 wt % of the nicotine present in the formulation is in protonated form. In one aspect from 80 to 95 wt % of the nicotine present in the formulation is in protonated form. In one aspect from 85 to 95 wt % of the nicotine present in the formulation is in protonated form. In one aspect from 90 to 95 wt % of the nicotine present in the formulation is in protonated form.

The relevant amounts of nicotine which are present in the formulation in protonated form are specified herein. These amounts may be readily calculated by one skilled in the art. Nicotine, 3-(1-methylpyrrolidin-2-yl) pyridine, is a diprotic base with pKa of 3.12 for the pyridine ring and 8.02 for the pyrrolidine ring It can exist in pH-dependent protonated (mono- and di-) and non-protonated (free base) forms which have different bioavailability.

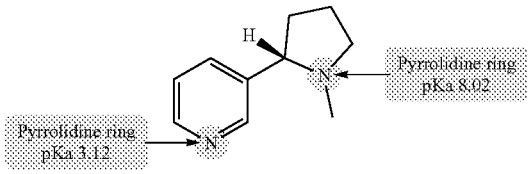

The distribution of protonated and non-protonated nicotine will vary at various pH increments.

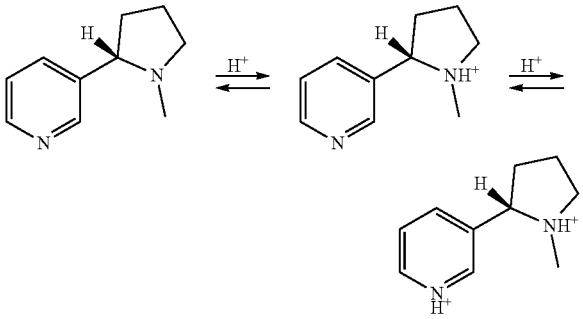

The fraction of non-protonated nicotine will be predominant at high pH levels whilst a decrease in the pH will see an increase of the fraction of protonated nicotine (mono- or di-depending on the pH). If the relative fraction of protonated nicotine and the total amount of nicotine in the sample are known, the absolute amount of protonated nicotine can be calculated.

The relative fraction of protonated nicotine in formulation can be calculated by using the Henderson-Hasselbalch equation, which describes the pH as a derivation of the acid dissociation constant equation, and it is extensively employed in chemical and biological systems. Consider the following equilibrium:

$$B+H^+ \rightleftarrows BH^+$$

The Henderson-Hasselbalch equation for this equilibrium is:

$$pH = pKa + \log\frac{[B]}{[BH+]}$$

Where [B] is the amount of non-protonated nicotine (i.e. free base), [BH+] the amount of protonated nicotine (i.e. conjugate acid) and pKa is the reference pKa value for the pyrrolidine ring nitrogen of nicotine (pKa=8.02). The relative fraction of protonated nicotine can be derived from the alpha value of the non-protonated nicotine calculated from the Henderson-Hasselbalch equation as:

$$\%\ \text{protonated nicotine} = 100 - \left\{\frac{\frac{[B]}{[BH+]}}{\left\{1+\frac{[B]}{[BH+]}\right\}} * 100\right\}$$

Determination of pKa values of nicotine formulations was carried out using the basic approach described in "Spectroscopic investigations into the acid-base properties of nicotine at different temperatures", Peter M. Clayton, Carl A. Vas, Tam T. T. Bui, Alex F. Drake and Kevin McAdam, Anal. Methods, 2013, 5, 81-88.

Acid

In one aspect the acid is an organic acid. In one aspect the acid is a carboxylic acid. In one aspect the acid is an organic carboxylic acid.

In one aspect the acid is selected from the group consisting of acetic acid, lactic acid, formic acid, citric acid, benzoic acid, pyruvic acid, levulinic acid, succinic acid, tartaric acid, sorbic acid, propionic acid, phenylacetic acid, and mixtures thereof. In one aspect the acid is selected from the group consisting of citric acid, benzoic acid, levulinic acid, lactic acid, sorbic acid, and mixtures thereof. In one aspect the acid is selected from the group consisting of citric acid, benzoic acid, levulinic acid, and mixtures thereof. In one aspect the acid is at least citric acid. In one aspect the acid consists of citric acid.

In one aspect the acid is selected from acids having a pKa of from 2 to 5. In one aspect the acid is a weak acid. In one aspect the acid is a weak organic acid.

In one aspect the acid has a solubility in water of at least 5 g/L at 20° C. In one aspect the acid has a solubility in water of at least 10 g/L at 20° C. In one aspect the acid has a solubility in water of at least 20 g/L at 20° C. In one aspect the acid has a solubility in water of at least 50 g/L at 20° C. In one aspect the acid has a solubility in water of at least 100 g/L at 20° C. In one aspect the acid has a solubility in water of at least 200 g/L at 20° C. In one aspect the acid has a solubility in water of at least 300 g/L at 20° C. In one aspect the acid has a solubility in water of at least 400 g/L at 20° C. In one aspect the acid has a solubility in water of at least 500 g/L at 20° C. In one aspect the acid has a solubility in water of at least 600 g/L at 20° C. In one aspect the acid has a solubility in water of at least 700 g/L at 20° C. In one aspect the acid has a solubility in water of at least 800 g/L at 20° C. In one aspect the acid has a solubility in water of at least 900 g/L at 20° C. In one aspect the acid has a solubility in water of at least 1000 g/L at 20° C. In one aspect the acid has a solubility in water of at least 1100 g/L at 20° C.

The molar ratio of acid to nicotine may be selected as desired. In one aspect the molar ratio of acid to nicotine is from 5:1 to 1:5. In one aspect the molar ratio of acid to nicotine is from 4:1 to 1:4. In one aspect the molar ratio of acid to nicotine is from 3:1 to 1:3. In one aspect the molar ratio of acid to nicotine is from 2:1 to 1:2. In one aspect the molar ratio of acid to nicotine is from 1.5:1 to 1:1.5. In one aspect the molar ratio of acid to nicotine is from 1.2:1 to 1:1.2. In one aspect the molar ratio of acid to nicotine is from 5:1 to 1:1. In one aspect the molar ratio of acid to nicotine is from 4:1 to 1:1. In one aspect the molar ratio of acid to nicotine is from 3:1 to 1:1. In one aspect the molar ratio of acid to nicotine is from 2:1 to 1:1. In one aspect the molar ratio of acid to nicotine is from 1.5:1 to 1:1. In one aspect the molar ratio of acid to nicotine is from 1.2:1 to 1:1.

In one aspect the total content of acid present in the formulation is no greater than 5 mole equivalents based on the nicotine. In one aspect the total content of acid present in the formulation is no greater than 4 mole equivalents based on the nicotine. In one aspect the total content of acid present in the formulation is no greater than 3 mole equivalents based on the nicotine. In one aspect the total content of acid present in the formulation is no greater than 2 mole equivalents based on the nicotine. In one aspect the total content of acid present in the formulation is no greater than 1 mole equivalents based on the nicotine.

In one aspect the total content of acid present in the formulation is no less than 0.01 mole equivalents based on the nicotine. In one aspect the total content of acid present in the formulation is no less than 0.05 mole equivalents based on the nicotine. In one aspect the total content of acid present in the formulation is no less than 0.1 mole equivalents based on the nicotine. In one aspect the total content of acid present in the formulation is no less than 0.2 mole equivalents based on the nicotine. In one aspect the total content of acid present in the formulation is no less than 0.3 mole equivalents based on the nicotine. In one aspect the total content of acid present in the formulation is no less than 0.4 mole equivalents based on the nicotine. In one aspect the total content of acid present in the formulation is no less than 0.5 mole equivalents based on the nicotine. In one aspect the total content of acid present in the formulation is no less than 0.7 mole equivalents based on the nicotine.

In one aspect the acid is present in an amount of no greater than 6 wt % based on the aerosolizable formulation. In one aspect the acid is present in an amount of from 0.01 to 6 wt % based on the aerosolizable formulation. In one aspect the acid is present in an amount of from 0.02 to 6 wt % based on the aerosolizable formulation. In one aspect the acid is present in an amount of from 0.05 to 6 wt % based on the aerosolizable formulation. In one aspect the acid is present in an amount of from 0.08 to 6 wt % based on the aerosolizable formulation. In one aspect the acid is present in an amount of from 0.01 to 5 wt % based on the aerosolizable formulation. In one aspect the acid is present in an amount of from 0.02 to 5 wt % based on the aerosolizable formulation. In one aspect the acid is present in an amount of from 0.05 to 5 wt % based on the aerosolizable formulation. In one aspect the acid is present in an amount of from 0.08 to 5 wt % based on the aerosolizable formulation. In one aspect the acid is present in an amount of no greater than 4 wt % based on the aerosolizable formulation. In one aspect the acid is present in an amount of from 0.01 to 4 wt % based on the aerosolizable formulation. In one aspect the acid is present in an amount of from 0.02 to 4 wt % based on the aerosolizable formulation. In one aspect the acid is present in an amount of from 0.05 to 4 wt % based on the aerosolizable formulation. In one aspect the acid is present in an amount of from 0.08 to 4 wt % based on the aerosolizable formulation. In one aspect the acid is present in an amount of no greater than 3 wt % based on the aerosolizable formulation. In one aspect the acid is present in an amount of from 0.01 to 3 wt % based on the aerosolizable formulation. In one aspect the acid is present in an amount of from 0.02 to 3 wt % based on the aerosolizable formulation. In one aspect the acid is present in an amount of from 0.05 to 3 wt % based on the aerosolizable formulation. In one aspect the acid is present in an amount of from 0.08 to 3 wt % based on the aerosolizable formulation. In one aspect the acid is present in an amount of no greater than 2 wt % based on the aerosolizable formulation. In one aspect the acid is present in an amount of from 0.01 to 2 wt % based on the aerosolizable formulation. In one aspect the acid is present in an amount of from 0.02 to 2 wt % based on the aerosolizable formulation. In one aspect the acid is present in an amount of from 0.05 to 2 wt % based on the aerosolizable formulation. In one aspect the acid is present in an amount of from 0.08 to 2 wt % based on the aerosolizable formulation. In one aspect the acid is present in an amount of no greater than 1 wt % based on the aerosolizable formulation. In one aspect the acid is present in an amount of from 0.01 to 1 wt % based on the aerosolizable formulation. In one aspect the acid is present in an amount of from 0.02 to 1 wt % based on the aerosolizable formulation. In one aspect the acid is present in an amount of from 0.05 to 1 wt % based on the aerosolizable formulation. In one aspect the acid is present in an amount of from 0.08 to 1 wt % based on the aerosolizable formulation. In one aspect the acid is present in an amount of from 0.1 to 1 wt % based on the aerosolizable formulation. In one aspect the acid is present in an amount of no greater than 0.6 wt % based on the aerosolizable formulation. In one aspect the acid is present in an amount of from 0.01 to 0.6 wt % based on the aerosolizable formulation. In one aspect the acid is present in an amount of from 0.02 to 0.6 wt % based on the aerosolizable formulation. In one aspect the acid is present in an amount of from 0.05 to 0.6 wt % based on the aerosolizable formulation. In one aspect the acid is present in an amount of from 0.08 to 0.6 wt % based on the aerosolizable formulation. In one aspect the acid is present in an amount of from 0.1 to 0.6 wt % based on the aerosolizable formulation. In one aspect the acid is present in an amount of no greater than 0.5 wt % based on the aerosolizable formulation. In one aspect the acid is present in an amount of from 0.01 to 0.5 wt % based on the aerosolizable formulation. In one aspect the acid is present in an amount of from 0.02 to 0.5 wt % based on the aerosolizable formulation. In one aspect the acid is present in an amount of from 0.05 to 0.5 wt % based on the aerosolizable formulation. In one aspect the acid is present in an amount of from 0.08 to 0.5 wt % based on the aerosolizable formulation.

In one aspect the acid is present in an amount of no greater than 0.2 wt % based on the aerosolizable formulation. In one aspect the acid is present in an amount of from 0.01 to 0.2 wt % based on the aerosolizable formulation. In one aspect the acid is present in an amount of from 0.02 to 0.2 wt % based on the aerosolizable formulation. In one aspect the acid is present in an amount of from 0.05 to 0.2 wt % based on the aerosolizable formulation. In one aspect the acid is present in an amount of from 0.08 to 0.2 wt % based on the aerosolizable formulation. In one aspect the acid is present in an amount of no greater than 0.1 wt % based on the aerosolizable formulation. In one aspect the acid is present in an amount of from 0.01 to 0.1 wt % based on the aerosolizable formulation. In one aspect the acid is present in an amount of from 0.02 to 0.1 wt % based on the aerosolizable formulation. In one aspect the acid is present in an amount of from 0.05 to 0.1 wt % based on the aerosolizable formulation. In one aspect the acid is present in an amount of from 0.08 to 0.1 wt % based on the aerosolizable formulation.

The amount of acid and the solubility of the acid may be selected such that a given amount of the acid will dissolve in the water. In one aspect at 20° C. at least 20% of the acid dissolves in the water. In one aspect at 25° C. at least 20% of the acid dissolves in the water. In one aspect at 30° C. at least 20% of the acid dissolves in the water. In one aspect at 20° C. at least 35% of the acid dissolves in the water. In one aspect at 20° C. at least 40% of the acid dissolves in the water. In one aspect at 20° C. at least 45% of the acid dissolves in the water. In one aspect at 20° C. at least 50% of the acid dissolves in the water. In one aspect at 20° C. at least 55% of the acid dissolves in the water.

Formulation

In one aspect the aerosolizable formulation further comprises one or more flavors or flavoring components. As used herein, the terms "flavor" and "flavorant" refer to materials which, where local regulations permit, may be used to create a desired taste or aroma in a product for adult consumers. They may include extracts (e.g. liquorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder. The one or more flavors may be selected from the group consisting of (4-(para-)methoxyphenyl)-2-butanone, vanillin, γ-undecalactone, menthone, 5-propenyl guaethol, menthol, para-mentha-8-thiol-3-one and mixtures thereof. In one aspect the flavor is at least menthol.

If present, the one or more flavors may be present in any suitable amount. In one aspect the one or more flavors are present in a total amount of no greater than 10 wt. % based on the aerosolizable formulation. In one aspect the one or more flavors are present in a total amount of no greater than 7 wt. % based on the aerosolizable formulation. In one aspect the one or more flavors are present in a total amount of no greater than 5 wt. % based on the aerosolizable formulation. In one aspect the one or more flavors are present in a total amount of no greater than 4 wt. % based on the aerosolizable formulation. In one aspect the one or more flavors are present in a total amount of no greater than 3 wt. % based on the aerosolizable formulation. In one aspect the one or more flavors are present in a total amount of no greater than 2 wt. % based on the aerosolizable formulation. In one aspect the one or more flavors are present in a total amount of no greater than 1 wt. % based on the aerosolizable formulation.

In one aspect the one or more flavors are present in a total amount of from 0.01 to 5 wt. % based on the aerosolizable formulation. In one aspect the one or more flavors are present in a total amount of from 0.01 to 4 wt. % based on the aerosolizable formulation. In one aspect the one or more flavors are present in a total amount of from 0.01 to 3 wt. % based on the aerosolizable formulation. In one aspect the one or more flavors are present in a total amount of from 0.01 to 2 wt. % based on the aerosolizable formulation. In one aspect the one or more flavors are present in a total amount of from 0.01 to 1 wt. % based on the aerosolizable formulation. In one aspect the one or more flavors are present in a total amount of from 0.01 to 0.5 wt. % based on the aerosolizable formulation.

As discussed above, in the present system the number of components present may be reduced leading to less chance of forming breakdown products/toxicants. Thus in one aspect there is provided an aerosolizable formulation as described herein consisting of (i) water; (ii) nicotine; (iii) the acid; and (iv) optionally one or more flavors. In one aspect there is provided an aerosolizable formulation as described herein consisting of (i) water; (ii) nicotine; (iii) the acid; and (iv) one or more flavors. In one aspect there is provided an aerosolizable formulation as described herein consisting of (i) water; (ii) nicotine; and (iii) the acid.

In one aspect if the aerosolizable formulation contains one or more cyclodextrins. One or more cyclodextrins may or may not be present in any suitable amount in the aerosolizable formulation. In one aspect the one or more cyclodextrins are present in a total amount of no greater than 12 wt. % based on the aerosolizable formulation. In one aspect the one or more cyclodextrins are present in a total amount of no greater than 10 wt. % based on the aerosolizable formulation. In one aspect the one or more cyclodextrins are present in a total amount of no greater than 9 wt. % based on the aerosolizable formulation. In one aspect the one or more cyclodextrins are present in a total amount of no greater than 8 wt. % based on the aerosolizable formulation. In one aspect the one or more cyclodextrins are present in a total amount of no greater than 7 wt. % based on the aerosolizable formulation. In one aspect the one or more cyclodextrins are present in a total amount of no greater than 6 wt. % based on the aerosolizable formulation. In one aspect the one or more cyclodextrins are present in a total amount of no greater than 5 wt. % based on the aerosolizable formulation. In one aspect the one or more cyclodextrins are present in a total amount of no greater than 4 wt. % based on the aerosolizable formulation. In one aspect the one or more cyclodextrins are present in a total amount of no greater than 3 wt. % based on the aerosolizable formulation. In one aspect the one or more cyclodextrins are present in a total amount of no greater than 2 wt. % based on the aerosolizable formulation. In one aspect the one or more cyclodextrins are present in a total amount of no greater than 1 wt. % based on the aerosolizable formulation. In one aspect the one or more cyclodextrins are present in a total amount of no greater than 0.1 wt. % based on the aerosolizable formulation. In one aspect the one or more cyclodextrins are present in a total amount of no greater than 0.01 wt. % based on the aerosolizable formulation. In one aspect the one or more cyclodextrins are present in a total amount of no greater than 0.001 wt. % based on the aerosolizable formulation.

The one or more cyclodextrins may be selected from the group consisting of unsubstituted cyclodextrins, substituted cyclodextrins and mixtures thereof. In one aspect at least one cyclodextrin is an unsubstituted cyclodextrin. In one aspect the one or more cyclodextrins are selected from the group consisting of unsubstituted cyclodextrins. In one aspect at least one cyclodextrin is a substituted cyclodextrin. In one aspect the one or more cyclodextrins are selected from the group consisting of substituted cyclodextrins.

In one aspect the one or more cyclodextrins are selected from the group consisting of unsubstituted (α)-cyclodextrin, substituted (α)-cyclodextrin, unsubstituted (β)-cyclodextrin, substituted (β)-cyclodextrin, unsubstituted (γ)-cyclodextrin, substituted (γ)-cyclodextrin, and mixtures thereof. In one aspect the one or more cyclodextrins are selected from the group consisting of unsubstituted (β)-cyclodextrin, substituted (β)-cyclodextrin, and mixtures thereof.

In one aspect the one or more cyclodextrins are selected from the group consisting of unsubstituted (α)-cyclodextrin, unsubstituted (β)-cyclodextrin, unsubstituted (γ)-cyclodextrin, and mixtures thereof. In one aspect the one or more cyclodextrins is selected from unsubstituted (β)-cyclodextrin.

In one aspect the one or more cyclodextrins are selected from the group consisting of substituted (α)-cyclodextrin, substituted (β)-cyclodextrin, substituted (γ)-cyclodextrin, and mixtures thereof. In one aspect the one or more cyclodextrins is selected from substituted (β)-cyclodextrins. Chemical substitutions at the 2-, 3-, and 6-hydroxyl sites are envisaged, and in particular substitution at the 2-position.

In one aspect the one or more cyclodextrins are selected from the group consisting of 2-hydroxy-propyl-α-cyclodextrin, 2-hydroxy-propyl-β-cyclodextrin, 2-hydroxy-propyl-γ-cyclodextrin and mixtures thereof. In one aspect the one or more cyclodextrins is at least 2-hydroxy-propyl-α-cyclodextrin. In one aspect the one or more cyclodextrins is at least 2-hydroxy-propyl-β-cyclodextrin. In one aspect the one or more cyclodextrins is at least 2-hydroxy-propyl-γ-cyclodextrin.

2-hydroxy-propyl derivatives of cyclodextrins, such as 2-hydroxy-propyl-β-cyclodextrin have increased solubility in water when compared to base cyclodextrins such as β-cyclodextrin.

In one aspect if the aerosolizable formulation contains one or more cyclodextrins, then the aerosolizable formulation contains no flavors that can be encapsulated by the one or more cyclodextrins.

Process

As discussed herein, in one aspect there is provided a process for forming an aerosol, the process comprising aerosolizing an aerosolizable formulation comprising (i) water in an amount of at least 50 wt. % based on the aerosolizable formulation;

(ii) nicotine; and (iii) one or more acids.

In the process the aerosol may be formed by a process performed at a temperature below 60° C. In the process the aerosol may be formed by a process performed at a temperature below 50° C. In the process the aerosol may be formed by a process performed at a temperature below 40° C. In the process the aerosol may be formed by a process performed at a temperature below 30° C. In the process the aerosol may be formed by a process performed at a temperature below 25° C. In the process the aerosol may be formed by a process which does not involve heating.

In the process the aerosol may be formed by applying ultrasonic energy to the aerosolizable formulation.

In one aspect the aerosol of the aerosolized formulation has a D50 of from 2 to 6 μm. References in the present specification to particle size distribution, D50, D10 or D90 refer to values measured in accordance with British and European Pharmacopoeia, 2.9.31 Particle Size Analysis By Laser Light Diffraction (see BRITISH PHARMACOPOEIA COMMISSION. (2014), British Pharmacopoeia. London, England: Stationery Office and COUNCIL OF EUROPE. (2013). European Pharmacopoeia. Strasbourg, France: Council of Europe). The terms D50, Dv50 and Dx50 are interchangeable. The terms D10, Dv10 and Dx10 are interchangeable. The terms D90, Dv90 and Dx90 are interchangeable.

In one aspect the aerosol has a D50 of from 2.5 to 6 μm. In one aspect the aerosol has a D50 of from 3 to 6 μm. In one aspect the aerosol has a D50 of from 3.5 to 6 μm. In one aspect the aerosol has a D50 of from 4 to 6 μm. In one aspect the aerosol has a D50 of from 4.5 to 6 μm. In one aspect the aerosol has a D50 of from 5 to 6 μm. In one aspect the aerosol has a D50 of from 2.5 to 5.5 μm. In one aspect the aerosol has a D50 of from 3 to 5.5 μm. In one aspect the aerosol has a D50 of from 3.5 to 5.5 μm. In one aspect the aerosol has a D50 of from 4 to 5.5 μm. In one aspect the aerosol has a D50 of from 4.5 to 5.5 μm. In one aspect the aerosol has a D50 of from 5 to 5.5 μm.

In one aspect the aerosol has a D10 of at least 0.5 μm. In one aspect the aerosol has a D10 of at least 1 μm. In one aspect the aerosol has a D10 of at least 2 μm.

In one aspect the aerosol has a D90 of no greater than 15 μm. In one aspect the aerosol has a D90 of no greater than 12 μm. In one aspect the aerosol has a D90 of no greater than 10 μm.

In one aspect D50 is measured after exclusion of particles having a particle size of less than 1 μm. In one aspect D10 is measured after exclusion of particles having a particle size of less than 1 μm. In one aspect D90 is measured after exclusion of particles having a particle size of less than 1 μm.

We have identified a water-based system which, by careful selection of the particle size distribution of the aerosol, delivers water droplets containing the active agent into desirable areas of the lungs, such as the deep lung. We have identified that in water-based aerosols, the droplets have a tendency to evaporate and decrease in size when inhaled by the user. Therefore the specific selection of particle size described herein addresses the reduction of size through evaporation and still delivers the active agent into the desired area of the lungs. These problems and the choice made in the present disclosure is in contrast to the prior liquids based on glycerol and propylene glycol in which the liquid droplets tend to adhere to moisture within the lungs and thereby increase in size when inhaled.

The formulation may be contained or delivered by any means. In one aspect the present disclosure provides a contained aerosolizable formulation comprising (a) one or more containers; and (b) an aerosolizable formulation as defined herein. The container may be any suitable container, for example to allow for the storage or delivery of the formulation. In one aspect the container is configured for engagement with an electronic aerosol provision system.

The container may be configured to become fluidly in communication with an electronic aerosol provision system so that formulation may be delivered to the electronic aerosol system. As described above, the present disclosure relates to container which may be used in an electronic aerosol provision system, such as an e-cigarette. Throughout the following description the term "e-cigarette" is used; however, this term may be used interchangeably with electronic aerosol provision system.

As discussed herein, the container of the present disclosure is typically provided for the delivery of aerosolizable formulation to or within an e-cigarette. The aerosolizable formulation may be held within an e-cigarette or may be sold as a separate container for subsequent use with or in an e-cigarette. As understood by one skilled in the art, e-cigarettes may contain a unit known as a detachable cartomizer which typically comprises a reservoir of aerosolizable formulation, a wick material and a heating element for vaporizing the aerosolizable formulation. In some e-cigarettes, the cartomizer is part of a single-piece device and is not detachable. In one aspect the container is a cartomizer or is part of a cartomizer. In one aspect the container is not a cartomizer or part of a cartomizer and is a container, such as a tank, which may be used to deliver nicotine formulation to or within an e-cigarette.

In one aspect the container is part of an e-cigarette. Therefore in a further aspect the present disclosure provides an electronic aerosol provision system comprising: an aerosolizable formulation as defined herein; an aerosolizer for aerosolizing formulation for inhalation by a user of the electronic aerosol provision system; and a power supply comprising a cell or battery for supplying power to the aerosolizer.

In addition to the aerosolizable formulation of the present disclosure and to systems such as containers and electronic aerosol provision systems containing the same, the present disclosure provides a process for improving the sensory properties of an aerosolized nicotine. In a further aspect the present disclosure provides a process for improving the storage stability of an aerosolized nicotine formulation.

Reference to an improvement in the sensory properties of a vaporized nicotine solution refer may include an improvement in the smoothness of the vaporized nicotine solution as perceived by a user.

The process of the present invention may comprises additional steps either before the steps listed, after the steps listed or between one or more of the steps listed.

The invention will now be described with reference to the following non-limiting example.

EXAMPLES

Example 1

A series of tests were conducted using commercially available vibrating mesh nebulizer devices. The "free base nicotine control" device was loaded with formulation containing 90.0% (w/w) water, 9.0% 2-hydroxy-propyl-β-cyclodextrin, 0.9% 1-menthol, and 0.1% nicotine.

A similar device was prepared wherein 0.05% w/w citric acid was added to the formulation, with the nicotine content was commensurately reduced to 0.05% (w/w). Relative to the molecular weights of nicotine (162.23 g/mol$^{-1}$) and citric acid (192.123 g/mol$^{-1}$), a 1:1 molar equivalent ratio is expected, indicating nicotine protonation at a level close to 100%.

Each of these devices was presented to 2 panelists comprising e-cigarette users, and the panelists were asked to puff on the devices in a sequential monadic fashion for 5 puffs on each device. They were asked to identify a preference for free base or protonated nicotine.

Both panelists showed a very strong preference for the formulation containing protonated nicotine. Both cited improved flavor transmission over the free base nicotine sample and improved sensory characteristics of nicotine e.g. throat catch and irritation.

Example 2

A series of tests were conducted using commercially available vibrating mesh nebulizer devices. The devices were loaded with formulation containing 99.6% (w/w) water and 0.4% (w/w) nicotine.

A similar device was prepared wherein 0.48% (w/w) citric acid was added to the formulation, with the water content was commensurately reduced to 99.12% (w/w). Relative to the molecular weights of nicotine (162.23 g/mol$^{-1}$) and citric acid (192.123 g/mol$^{-1}$), a 1:1 molar equivalent ratio is expected, indicating nicotine protonation at a level close to 100%.

A similar device was prepared wherein 0.4% (w/w) malic acid was added to the formulation, with the water content was commensurately reduced to 99.2% (w/w). Relative to the molecular weights of nicotine (162.23 g/mol$^{-1}$) and malic acid (134.09 g/mol$^{-1}$), a 1:1 molar equivalent ratio is expected, indicating nicotine protonation at a level close to 100%.

A similar device was prepared with formulation containing 77.6% (w/w) water, 15.0% (w/w) 2-hydroxy-propyl-β-cyclodextrin, 7.0% (w/w) Apple flavor, and 0.4% (w/w) nicotine.

A similar device was prepared wherein 0.4% (w/w) benzoic acid was added to the formulation, with the water content was commensurately reduced to 77.2% (w/w). Relative to the molecular weights of nicotine (162.23 g/mol$^{-1}$) and benzoic acid (122.12 g/mol$^{-1}$), a 1:1 molar equivalent ratio is expected, indicating nicotine protonation at a level close to 100%.

A similar device was prepared wherein 0.4% (w/w) malic acid was added to the formulation, with the water content was commensurately reduced to 77.2% (w/w). Relative to the molecular weights of nicotine (162.23 g/mol$^{-1}$) and malic acid (134.09 g/mol$^{-1}$), a 1:1 molar equivalent ratio is expected, indicating nicotine protonation at a level close to 100%.

TABLE 1

Summary of tested formulation codes, particle size distributions and used acids.

| Formulation code | flavor | acid | D50, μm |
|---|---|---|---|
| Hydra-066 | No | No | 5.07 |
| Hydra-055 | No | Citric | 4.65 |
| Hydra-056 | No | Malic | 4.66 |
| Hydra-072 | Apple | No | 4.17 |
| Hydra-073 | Apple | Citric | 4.26 |
| Hydra-074 | Apple | Benzoic | 4.24 |

The Droplet Size Distribution (DSD) formed on actuation of the device was determined by laser diffraction using Malvern Instruments (Worcestershire, UK) Spraytec system. The position of the aerosol source (e.g. the Device mouthpiece) was kept constant and at a fixed distance from the laser beam (2.5 cm) for the duration of the measurements, and to ensure appropriate actuation into the path of the laser beam. Measurements were performed in triplicates and an average D50 values reported in the Table 1. Typical particle size distributions of each formulation are presented in FIGS. 2A to 2F.

Seven (7) panelists took part in sensory evaluations of unflavoreded formulation. Only 1 out of 7 panelists (a high nicotine user) preferred unprotonated formulation over protonated versions. 6 out 7 panelists preferred protonated versions (1 liked citric acid, 5 liked malic acid protonated version).

Figure 3A:
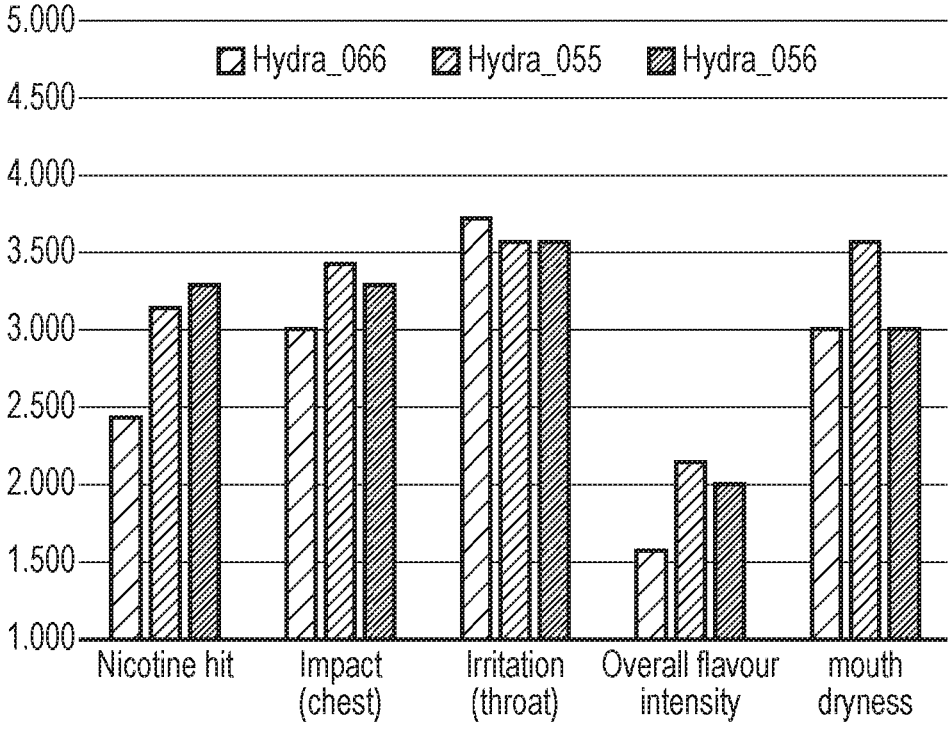
FIGS. 3A and 3B show graphical representation of the sensory feedback on selected attributes.
Figure 3B:
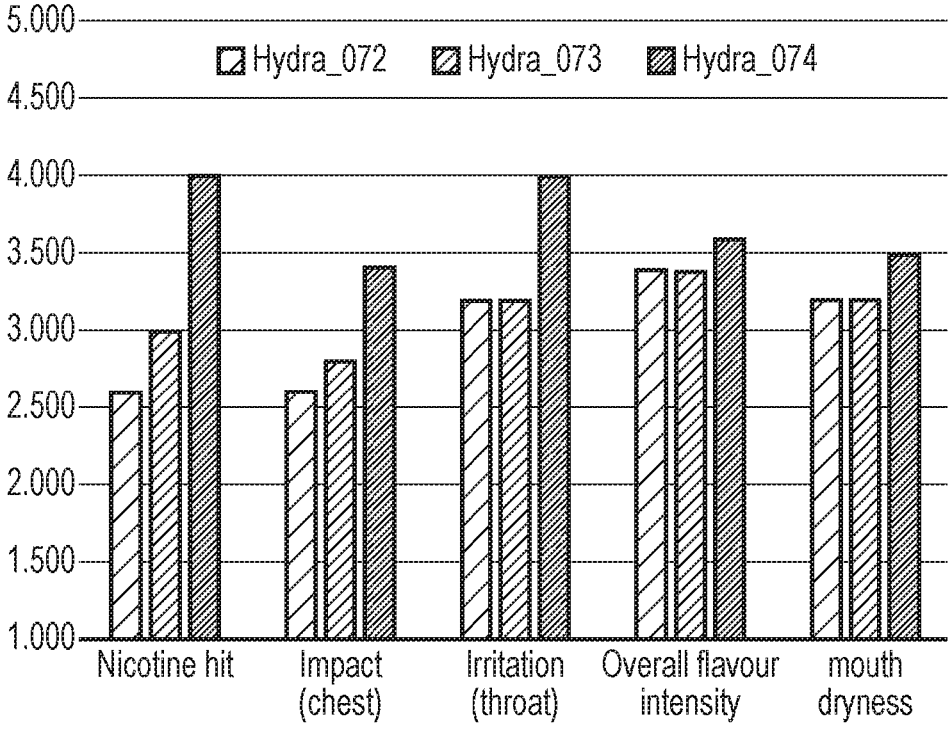

Five (5) panelists took part in sensory evaluations of the apple flavored formulations. Only 1 out of 5 panelists preferred unprotonated formulation over protonated versions. 4 out 5 panelists preferred protonated versions (1 liked citric acid, 3 liked benzoic acid protonated version). Overall nicotine hit, chest impact and flavor intensity were rated higher for protonated formulations. The results of this assessment are shown in FIGS. 3A and 3B.

Various modifications and variations of the present invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

The invention claimed is:

1. An aerosolizable formulation comprising (i) water in an amount of at least 50 wt. % based on the aerosolizable formulation;

ii) nicotine;

(iii) one or more acids present in a total amount of from 0.2 to 1 wt. % based on the aerosolizable formulation; and (iv) one or more cyclodextrins, wherein the molar ratio of the one or more acids to the nicotine is from 5:1 to 1:1.

2. The aerosolizable formulation according to claim 1, wherein water is present in an amount of at least 75 wt. % based on the aerosolizable formulation.

3. The aerosolizable formulation according to claim 1, wherein water is present in an amount of at least 90 wt. % based on the aerosolizable formulation.

4. The aerosolizable formulation according to claim 1, wherein the nicotine is present in an amount of no greater than 1 wt. % based on the aerosolizable formulation.

5. The aerosolizable formulation according to claim 4, wherein the nicotine is present in an amount of from 0.01 to 0.6 wt. % based on the aerosolizable formulation.

6. The aerosolizable formulation according to claim 1, wherein at least 5 wt. % of the nicotine present in the formulation is in a protonated form.

7. The aerosolizable formulation according to claim 1, wherein at least 50 wt. % of the nicotine present in the formulation is in a protonated form.

8. The aerosolizable formulation according to claim 1, wherein at least 90 wt. % of the nicotine present in the formulation is in a protonated form.

9. The aerosolizable formulation according to claim 1, wherein the one or more acids is selected from the group consisting of acetic acid, lactic acid, formic acid, citric acid, benzoic acid, pyruvic acid, levulinic acid, succinic acid, tartaric acid, sorbic acid, propionic acid, phenylacetic acid, and mixtures thereof.

10. The aerosolizable formulation according to claim 1, wherein the one or more acids comprises citric acid.

11. The aerosolizable formulation according to claim 1, further comprising one or more flavors.

12. The aerosolizable formulation according to claim 11, wherein the one or more flavors are selected from the group consisting of (4-(para-) methoxyphenyl)-2-butanone, vanillin, γ-undecalactone, menthone, 5-propenyl guaethol, menthol, para-mentha-8-thiol-3-one and mixtures thereof.

13. The aerosolizable formulation according to claim 11, wherein the one or more flavors comprises menthol.

14. The aerosolizable formulation according to claim 11, wherein the one or more flavors are present in a total amount of no greater than 2 wt. % based on the aerosolizable formulation.

15. The aerosolizable formulation according to claim 11, wherein the one or more flavors are present in a total amount of from 0.01 to 1 wt. % based on the aerosolizable formulation.

16. A process for forming an aerosol, the process comprising aerosolizing the aerosolizable formulation of claim 1.

17. The process according to claim 16, wherein the aerosolizable formulation is aerosolized to form the aerosol at a temperature below 50° C.

18. The process according to claim 16, wherein aerosolizing the aerosolizable formulation comprises applying ultrasonic energy to the aerosolizable formulation.

19. The aerosolizable formulation according to claim 1, wherein the aerosolizable formulation is contained within a container.

20. The contained aerosolizable formulation according to claim 19, wherein the container is configured for engagement with an electronic aerosol provision system.

21. An electronic aerosol provision system comprising:

(a) an aerosolizer for aerosolizing an aerosolizable formulation for inhalation by a user of the electronic aerosol provision system;

(b) a power supply comprising a cell or battery for supplying power to the aerosolizer; and (c) the aerosolizable formulation, comprising:

(i) water in an amount of at least 50 wt. % based on the aerosolizable formulation;

(ii) nicotine;

(iii) one or more acids present in a total amount of from 0.2 to 1 wt. % based on the aerosolizable formulation; and (iv) one or more cyclodextrins, wherein the molar ratio of the one or more acids to the nicotine is from 5:1 to 1:1.

22. A process for improving the sensory properties of an aerosolized nicotine formulation, the process comprising the steps of:

(a) providing an aerosolizable material comprising (i) water in an amount of at least 50 wt. % based on the aerosolizable material and (ii) nicotine; and (b) incorporating into the aerosolizable material one or more acids and one or more cyclodextrins, wherein the one or more acids are present in a total amount of from 0.2 to 1 wt. % based on the aerosolizable formulation, and wherein the molar ratio of the one or more acids to the nicotine is from 5:1 to 1:1.

* * * * *